US012774575B2

(12) United States Patent
Romeijn

(10) Patent No.: US 12,774,575 B2
(45) Date of Patent: Oct. 27, 2026

(54) PILE DRIVING SYSTEM AND VESSEL

(71) Applicant: ITREC B.V., Schiedam (NL)

(72) Inventor: Eric Romeijn, Schiedam (NL)

(73) Assignee: ITREC B.V., Schiedam (NL)

( * ) Notice: Subject to any disclaimer, the term of this patent is extended or adjusted under 35 U.S.C. 154(b) by 69 days.

(21) Appl. No.: 18/912,147

(22) Filed: Oct. 10, 2024

(65) Prior Publication Data

US 2025/0034826 A1 Jan. 30, 2025

Related U.S. Application Data

(62) Division of application No. 17/424,279, filed as application No. PCT/NL2020/050029 on Jan. 21, 2020, now Pat. No. 12,123,159.

(30) Foreign Application Priority Data

| | | |
|---|---|---|
| Jan. 21, 2019 | (NL) | 2022426 |
| Mar. 28, 2019 | (NL) | 2022829 |
| May 27, 2019 | (NL) | 2023210 |

(51) Int. Cl.
*E02D 7/08* (2006.01)
*E02D 13/00* (2006.01)
(Continued)

(52) U.S. Cl.
CPC ..... *E02D 7/08* (2013.01); *E02D 13/00* (2013.01); *E02D 13/04* (2013.01); *E02B 17/08* (2013.01);
(Continued)

(58) Field of Classification Search
CPC ..... E02D 7/08; E02D 13/00; E02D 13/04; E02D 17/08; E02D 7/00; E02D 7/06; E02D 27/425; E02D 27/525
See application file for complete search history.

(56) References Cited

U.S. PATENT DOCUMENTS

| | | | |
|---|---|---|---|
| 3,417,828 | A | 12/1968 | Duyster et al. |
| 3,797,585 | A | 3/1974 | Ludvigson |

(Continued)

FOREIGN PATENT DOCUMENTS

| | | | |
|---|---|---|---|
| CN | 201891117 | U | 7/2011 |
| CN | 104404959 | A | 3/2015 |

(Continued)

OTHER PUBLICATIONS

"H 15 L Hydraulic Free-Fall Hammer" Liebherr, Nov. 2, 2016, https://youtu.be/b7BuKNYb7hA.

(Continued)

*Primary Examiner* — Sean D Andrish

(74) *Attorney, Agent, or Firm* — Birch, Stewart, Kolasch & Birch, LLP

(57) ABSTRACT

A pile driving system for driving a pile into the soil comprises a drive head member on a top end of the pile to engage the pile, a lift system between the drive head member and the drop tank for bringing the drop tank into an initial height position relative to the drive head member, and a quick release system for quick release of the lift system so that the drop tank falls down from said initial height position. It further comprises a liquid fillable drop tank, that has a capacity to hold more than 500 m3 of a liquid therein and that is vertically mobile above and relative to the drive head member, and an energy transfer assembly configured for transfer of energy from the falling drop tank to the drive head member.

20 Claims, 16 Drawing Sheets

(51) Int. Cl.

| | |
|---|---|
| ***E02D 13/04*** | (2006.01) |
| *E02B 17/08* | (2006.01) |
| *E02D 27/42* | (2006.01) |
| *E02D 27/52* | (2006.01) |

(52) U.S. Cl.
CPC ..... *E02D 27/425* (2013.01); *E02D 27/525* (2013.01); *E02D 2200/1685* (2013.01)

(56) References Cited

U.S. PATENT DOCUMENTS

| | | | | |
|---|---|---|---|---|
| 3,842,917 | A * | 10/1974 | Wisotsky | E02D 7/00 173/90 |
| 4,102,408 | A | 7/1978 | Ludvigson | |
| 4,262,755 | A | 4/1981 | Kuhn | |
| 4,362,439 | A | 12/1982 | Vaynkof | |
| 4,688,646 | A | 8/1987 | Speckhart et al. | |
| 4,817,733 | A | 4/1989 | Hennecke et al. | |
| 2007/0277989 | A1 | 12/2007 | Hessels et al. | |
| 2008/0292408 | A1 | 11/2008 | Kothnur et al. | |
| 2019/0226173 | A1 | 7/2019 | Desborough et al. | |

FOREIGN PATENT DOCUMENTS

| | | | |
|---|---|---|---|
| CN | 107761730 | A | 3/2018 |
| DE | 89 00 692 | U1 | 3/1989 |
| DE | 103 40 088 | A1 | 4/2005 |
| EP | 2 372 143 | A1 | 10/2011 |
| EP | 2 886 722 | A1 | 6/2015 |
| GB | 452564 | | 8/1936 |
| GB | 808931 | | 2/1959 |
| GB | 1180466 | | 2/1970 |
| GB | 1 266 596 | | 3/1972 |
| GB | 2 312 659 | A | 11/1997 |
| TW | M522246 | U | 5/2016 |
| WO | WO 00/06834 | A1 | 2/2000 |

OTHER PUBLICATIONS

"Liebherr Unveils Hydraulic Free-Fall Hammer", GeoDrilling International, Feb. 7, 2017, pp. 1-3, https://www.geodrillinginternational.com/issue/issue/1140238/liebherr-unveils-hydraulic-free-fall-hammer.

Dutch Search Report, issued in Priority Application No. 2023210, dated Nov. 13, 2019.

English translation of Chinese Office Action for Chinese Application No. 202080022266X, dated Jul. 26, 2022.

European Third Party Observationfor European Application No. 20702178.3, dated Feb. 16, 2023.

International Search Report, issued in PCT/NL2020/050029, dated May 12, 2020.

Written Opinion of the International Searching Authority, issued in PCT/NL2020/050029, dated May 12, 2020.

* cited by examiner

PILE DRIVING SYSTEM AND VESSEL

This application is a Divisional of copending application Ser. No. 17/424,279, filed on Jul. 20, 2021, which is the National Phase under 35 U.S.C. § 371 of International Application No. PCT/NL2020/050029, filed on Jan. 21, 2020, which claims the benefit under 35 U.S.C. § 119(a) to Patent Application Nos. 2022426 filed in the Netherlands on Jan. 21, 2019, U.S. Pat. No. 2,022,829 filed in the Netherlands on Mar. 28, 2019, and U.S. Pat. No. 2,023,210 filed in the Netherlands on May 27, 2019, all of which are hereby expressly incorporated by reference into the present application.

FIELD OF THE INVENTION

The present invention relates to the field of pile driving. The present invention envisages as a particular embodiment the driving of large diameter open ended and hollow piles, e.g. having an outer diameter of at least 5 meters. Such large piles are nowadays, for example, employed as monopile foundations for offshore wind turbines. Practical embodiments nowadays envisaged include monopiles having a diameter between 5 and 12 meters, and lengths between 60 and 120 meters.

BACKGROUND OF THE INVENTION

U.S. Pat. No. 4,817,733 discloses a pile driving method wherein use is made of a pile driving system, which pile driving system comprises:

- a drive head member that is configured to be arranged on the top end of the pile,
- a drop weight that is vertically mobile above the drive head member,
- a lift system arranged between the drive head member and the drop weight, which lift system is configured to bring the drop weight into an initial height position relative to the drive head,
- a quick release system adapted to effect quick release of the lift system so that the drop weight falls down from said initial height position,
- an energy transfer assembly configured for transfer of energy from the falling drop weight to the drive head member.

For driving the pile into the soil, the method comprising a repeated cycle wherein:

- the drop weight is lifted by means of the lift system into a desired initial height position,
- the quick release mechanism is operated to effect quick release of the lift system so that the drop weight falls down from said initial height position towards the drive head member, wherein energy from the falling drop weight is transferred by the energy transfer assembly to the drive head member and thereby to the top end of the pile, so that the pile is driven deeper into the soil.

The present invention aims to provide measures that result in an improved or at least alternative pile driving method, e.g. in view of an envisaged application for driving of large diameter open ended and hollow piles, e.g. having an outer diameter of at least 5 meters, e.g. employed as monopile foundations for offshore wind turbines.

OBJECT OF THE INVENTION

The present invention aims to provide measures that result in an improved or at least alternative pile driving method, e.g. in view of an envisaged application for driving of large diameter open ended and hollow piles, e.g. having an outer diameter of at least 5 meters, e.g. employed as monopile foundations for offshore wind turbines.

SUMMARY OF THE INVENTION

The invention provides a system for driving a pile into the soil, comprising a drop weight of considerably larger mass than in the prior art. In the field, the largest mass of the accelerated ram block is about 200 tonnes. The invention envisages a total drop weight mass that is multiple times larger than in the prior art, e.g. of at least 500 tonnes and preferably far greater.

In an envisaged use of the system, a large diameter pile having an outer diameter of at least 5 meters is driven into the soil, e.g. into the seabed. For example this is a hollow and open ended pile, e.g. a monopile of an offshore wind turbine.

A drive head member of the system is configured to engage the pile, e.g. is configured to be arranged on the top end of the pile. The drive head member is configured to have a considerable mass as well, e.g. a mass of at least 100 tonnes, e.g. at least 250 tonnes, e.g. of more than 500 tonnes.

The system further comprises a lift system, a quick release system and an energy transfer assembly. The lift system is arranged between the drive head member and the drop weight, that is configured to bring the drop tank into an initial height position relative to the drive head member. The quick release system is adapted to effect quick release of the lift system so that the drop weight falls down from said initial height position. The energy transfer assembly is configured for transfer of energy from the falling drop weight to the drive head member.

The enormous mass of the mass drop weight allows to dispense with any mechanism that would provide additional acceleration of the drop weight during the fall, so that the fall is solely under the influence of gravity, so at 1G. This allows for a much simpler design than the well-known accelerated hydraulic hammer, wherein the ram block of the hammer is accelerated by gas pressure acting on the piston type ram block to a blow rate corresponding to twice the rate of free drop.

The enormous mass of the falling, non-accelerated drop weight may be chosen to be closer to the total mass of the pile to be driven, which may be 500 tonnes or more, than with the known accelerated hydraulic impact hammers.

The use of an enormous drop weight mass, dropping under gravity in absence of further acceleration, will in the inventive concept cause a relatively long duration energy transfer. This enhances pile driving efficiency and contributes to a reduction of piling noise.

It is proposed to embody the drop weight as a liquid fillable drop tank, that has a considerably large capacity for holding liquid. It has a capacity to at least hold at least 50 m3 (cubic meter), preferably at least 100 m3, e.g. more than 500 m3, e.g. more than 1000 m3, of a liquid therein. The drop tank is vertically mobile relative to, e.g. above, the drive head member.

The pile driving system is operable in a repeated cycle for driving the pile into the soil, wherein after filling of the drop tank at least partially with liquid to set a desired total mass of the drop tank:

- the liquid filled drop tank is lifted by means of the lift system into a desired initial height position,
- the quick release mechanism is operated to effect quick release of the lift system so that the liquid filled drop tank falls down from said initial height position towards the drive head member, and wherein energy from the falling liquid filled drop tank is transferred by said energy transfer assembly to the drive head member and thereby to the pile, e.g. to the top end of the pile, so that the pile is driven deeper into the soil.

For example, the drop weight is dropped over a height of between 0.3 and 2.0 meters, e.g. of about or at most of 1 meter.

The liquid acts as mass supported by a bottom of the tank, and does not act as a hammer within the tank as the liquid falls along with the tank upon release of the tank from its initial position. Therefore, in practical embodiments, the liquid filled drop tank is released to fall solely based on gravity and in a non-submerged situation, so that the energy of the falling liquid filled tank is generally made available for the pile driving. So, it is envisaged that there is no additional downward acceleration of the falling liquid filled tank, e.g. in contrast to known arrangements wherein an additional downward hydraulic pressure acts on a solid impact type drop weight.

The liquid may be a pumpable slurry, yet water, e.g. seawater, is preferred.

It is envisaged that the mass of liquid in the drop tank remains stationary within the tank during the fall, in order to avoid that the liquid mass becomes a separate hammer within the drop tank. Of course, e.g. upon retardation of the drop tank, e.g. due to an impact energy transfer or some non-impact energy transfer to the pile, and/or due to recoil effects, the liquid may temporarily become non-stationary relative to the tank, at least to some degree.

It is envisaged that the tank, e.g. each tank member thereof, has a bottom and a peripheral wall that is fixed to the bottom. There is no vertically movable piston type bottom or the like within the tank, neither is the bottom of the tank made as a piston upon which the liquid mass rests. Given the enormous volume of the tank, minimal 50 m3, any piston would be impractical and unduly complex.

In view of the desire that the mass of liquid falls along with the tank as one drop weight, in an embodiment one or more compartments may be formed within a single tank, e.g. with separating walls (e.g. horizontally, vertically, diagonal) separating the compartments. For example separation walls are provided with openings therein, e.g. as bulkheads and/or screens that reduce sloshing.

In view of the desire that the mass of liquid falls along with the tank as one drop weight, in an embodiment one or more sloshing reducing or preventing members, e.g. bulkheads, screens, or one or more porous bodies are placed in the tank, e.g. the tank being filled with removable porous bodies that act to prevent or dampen any sloshing. For example, such porous bodies can for example be made of plastic, e.g. molded or of plastic foam, or made of concrete, or of a fabric, e.g. of a knitted or a woven fabric.

When filled with water, e.g. with seawater when pile driving is done at sea, the weight of the drop tank will thus at least be 50 tonnes. For diameters of open ended piles of more than 5 meters, the tank could be design to have a holding capacity of over 100 m3, or over 500 m3, in practical embodiments.

It will be appreciated that the weight of the structure of the liquid fillable drop tank also plays a role in the total mass that is dropped from the initial height.

Of course the dimensions of the drop tank according to the second aspect of the invention will be vastly greater than pile driving systems wherein the drop weight is made out of solid steel, that is about 7.8 times heavier than, for example, water. The drawback of the potentially enormous dimensions of the drop tank, e.g. when over 500 m3 may be offset by a number of potential advantages.

One advantage is that the tank can be transported empty and filled locally at the installation site with liquid, preferably water, e.g. seawater. This reduces transport efforts and facilitates handling and/or storage when not in use, e.g. aboard a vessel, e.g. aboard a jack-up type installation vessel.

Another advantage is that the effective weight of the drop tank can be readily adjusted, in embodiments even during the process of installation of a pile into the soil. For example piling can start with the tank being empty, or filled only for a fraction, with the tank being filled more and more as the pile is driven deeper into the soil. One could also envisage that the tank filling is varied depending on the soil strata that are to be penetrated.

Cleary when piling is done at sea, e.g. for a wind turbine monopile, filling the tank with seawater is preferred as this is available in abundance and the tank can readily discharged back into the sea.

Another advantage of the drop tank is that the liquid can be easily supplied to the tank and discharged. Even on land and remote from any source of water, one could supply water by means of tanker vehicles and discharge the water back into the tanker vehicles after use. All that remains to be transported then is the empty drop tank.

Preferably, a single liquid fillable drop tank is employed for driving the pile. This for instance allows to avoid the use of multiple liquid fillable drop tanks each with an associated lift mechanisms for driving a single pile. This allows for reduced complexity of the pile driving system and also allows to avoid the need for accurate synchronization of the fall of multiple liquid fillable drop tanks, e.g. in contrast to US2007277989 wherein the action of the drop weights of the multiple impact hammer pile driving devices placed on a single monopile needs to be synchronized within 10 milliseconds or less.

The liquid fillable drop tank may be embodied as a single tank with a bottom and a peripheral wall, preferably also with a top cover.

The liquid fillable drop tank may be provided with a rapid relief valve structure that is configured for rapid discharge of liquid, e.g. water, from the drop tank, e.g. in case of a (potential) emergency. For example, the relief valve comprises an explosive actuator to open a relief passage. For example, the rapid relief valve structure may be linked to an automated detection of the orientation of the pile, e.g. so as to detect undue pile motion during piling.

In an embodiment, the liquid fillable drop tank comprises a group of tank members, e.g. a group of pipe sections, e.g. of cylindrical pipe sections arranged vertically in an array. The group of tank members is then mounted on a common tank frame, each tank member being fillable with a volume of liquid. This may facilitate construction of the drop tank, e.g. making use of existing steel pipes to fabricate the tank members. For example, each tank member is cylindrical with a diameter between 0.5 and 2.5 meters. A cylindrical steel pipe type tank member can be provided with external reinforcements, e.g. ribs.

In a simple embodiment, the drop tank forms an impact type pile driving drop weight, with the drop tank falling onto an anvil provided on the pile driving head and the energy being transferred upon impact as in U.S. Pat. No. 4,817,733.

Alternatively to the drop tank, it is proposed to embody the drop weight as a solid mass drop weight assembly. This solid mass drop weight assembly comprises a support structure and solid drop weight elements supported by said support structure, preferably solid steel drop weight elements being composed of steel elements, e.g. stackable steel elements. The drop weight elements have a total mass of at least 100 tonnes, e.g. more than 500 tonnes, e.g. more than 1000 tonnes, e.g. more than 2000 tonnes, e.g. up to 3000 tonnes. The drop weight assembly is vertically mobile relative to, e.g. above, the drive head member.

It will be appreciated that the weight of the support structure also plays a role in the total mass that is dropped from the initial height. For example, the support structure has a mass of at least 100 tonnes, e.g. at least 250 tonnes, e.g. at least 500 tonnes. The weight of this structure is in practical embodiments predominantly governed by the required strength, e.g. in view of the capability to handle a drop weight elements composition weighing over 500, 1000, or even over 2000 tonnes, e.g. up to 3000 tonnes.

In embodiments, the support structure is embodied to support thereon solid drop weight elements having mass in total of at least 500, e.g. at least 100, preferably at least 2000 tonnes.

In an embodiment of the first aspect of the invention, the pile driving system comprises multiple vertically extending guide members that are arranged on the drive head member which serve to vertically guide the support structure. For example, these guide members are embodied as pylons, e.g. circular cross-section pylons, that are arranged on the drive head member and extend upwards, e.g. through respective slide bearing members provided on the support structure.

In an embodiment, the pile driving system comprises multiple vertically extending guide members that are arranged on the drive head member, which extend through respective slide bearing members provided on the support structure and which protrude above the support member, even in its initial position. In an embodiment, pylons form the vertically extending guide members.

The guide members may be configured and used as guides during stacking and destacking of solid drop weight elements. For example, the guide members are configured to interact with a lifting tool of a crane that is used in said stacking and destacking of the elements, so that the tool is guided by said guide members.

In a practical embodiment, the drop weight of the first aspect of the invention is composed of stackable steel elements, e.g. planar steel elements, that are stacked on the support structure between the pylons.

For example, four pylons are arranged on the support structure or on the drive head member. For example, elongated steel plates serving as solid drop weight elements are stacked between the four pylons.

The following discussion of embodiments apply to both the embodiment of the drop weight as a drop tank and the alternative embodiment thereof as the assembly of solid drop weight elements.

In a preferred embodiment, the energy transfer from the drop weight assembly or from the drop tank to the drive head is devoid of a mechanical impact energy transfer between the drop weight assembly or the drop tank and drive head, e.g. the energy transfer assembly is devoid of an anvil. This is envisaged in particular when piling is done offshore in order to avoid undue piling noise, e.g. allowing to dispense with or at least reduce the efforts for a noise mitigation screen or the like at the piling location.

In a preferred embodiment, the energy transfer assembly comprises one or more spring devices and/or one or more damper devices, that are effective between the drop weight assembly and the drive head member or between the drop tank and the drive head member. As preferred, this is done in absence of any mechanical impact type energy transfer, so in absence of the drop weight assembly or the drop tank striking an anvil.

It will be appreciated that in the field of pile driving a range of energy transfer assemblies comprising one or more spring devices and/or one or more damper devices is known. For instance, reference is made here to U.S. Pat. Nos. 4,102,408, 3,797,585, 4,688,646, and 3,417,828. It is noted that these documents all contain energy transfer assemblies that are impacted by a drop weight, with the assembly then shaping the resulting blow that is transferred to the pile to be driven into the ground. In embodiments of the invention one could envisage that the drop weight assembly or the drop tank is not made to impact on the spring devices and/or on the one or more damper devices, but is already supported thereon when in the initial height position so that no mechanical impact occurs.

In an embodiment, the energy transfer assembly comprises multiple gas spring devices, that each comprise a compressible gas filled variable volume chamber that is reduced in volume as the drop weight assembly or the drop tank falls. The reduction in volume may result in an increase of gas pressure in the gas filled variable volume chamber.

In an embodiment, the system energy transfer assembly comprises one or more pressurized gas storage vessels, that are in communication with the compressible gas filled variable volume chambers. The volume of gas within the storage vessels, any gas ducts, and variable volume chambers may in practical embodiments be such that the reduction in volume due to the fall of the drop weight assembly or the drop tank has no noticeable influence on the gas pressure. In other embodiments, the reduction in volume may result in a rapid increase of gas pressure. Preferably, the gas pressure within a gas circuit formed by the one or more gas storage vessels, any gas ducts, and variable volume chambers is adjustable.

In an embodiment, the system energy transfer assembly comprises multiple gas circuits, each containing a least one pressurized gas storage vessel, wherein the gas circuits have different gas pressures (e.g. when the drop weight or the drop tank is in the initial height position), wherein some of the multiple gas spring devices are in communication with a first gas circuit having a first gas pressure, and some of the multiple gas spring devices are in communication with a second gas circuit having a second gas pressure, distinct from the first gas pressure. This arrangement may be used to achieve, for example, a desired action of the totality of the energy transfer assembly, e.g. like putting different mechanical springs in parallel. In an embodiment one or more of the multiple gas spring devices are selectively brought in communication with one of the first and the second gas circuits, e.g. each being connected via a selector valve arrangement to one first and second gas circuits.

In an embodiment, the system energy transfer assembly comprises multiple gas circuits, each containing a least one pressurized gas storage vessel, wherein the gas circuits have different gas pressures (e.g., when the drop weight or the drop tank is in the initial height position). Herein some of the multiple gas spring devices are in communication with a first gas circuit having a first gas pressure, and some of the multiple gas spring devices are in communication with a second gas circuit having a second gas pressure, distinct from the first gas pressure. This could for example be done in an alternating arrangement, wherein the gas spring devices are arranged in an annular array and the gas spring devices are in alternation connected to the first or the second gas circuit. In another embodiment, one could use—in the context of an annular array of gas spring devices—the provision of two or more gas circuits and different gas pressure provided thereby to allow for a circumferential variation of the gas pressure in the gas spring devices, e.g. wherein the one or more gas spring devices in one circumferential zone of the annular array are operated at a first gas pressure whereas the remainder of the annular array is operated at the second gas pressure. For instance, this approach may be useful to control tilting of the pile during driving, e.g. due to uneven soil resistance seen in circumferential direction of the pile.

As preferred, the multiple gas spring devices already, possibly lightly, support the drop weight assembly or the drop tank relative to the drive head when the drop weight assembly or the drop tank is in the initial height position so that no mechanical impact occurs between the drop weight assembly or the drop tank and the spring device and no mechanical impact occurs between the spring devices and the drive head, e.g. the spring devices being mounted on the drive head and having a free end directed towards, e.g. connected to, the drop weight assembly.

In an embodiment, the energy transfer assembly comprises multiple liquid damper devices, each liquid damper device comprising a liquid filled variable volume chamber and an associated liquid flow resistance through which at least a part of said liquid is forced upon compression of the liquid filled variable volume chamber by the falling drop weight assembly or drop tank. Whilst a spring in theory dissipates no energy, it may well be desirable to have a significant, and preferably adjustable, damper capacity in the energy transfer assembly.

For instance, in an embodiment, the energy transfer assembly comprises both multiple gas spring devices and multiple damper devices, possibly embodied as multiple integrated spring and damper devices. In another embodiment, gas spring devices are arranged in a circular array on the drive head member and damper devices are arranged in a concentric circular array on the drive head member.

In an embodiment, upon release of the drop weight assembly or the drop tank from its initial height, first the one or more gas spring devices are active in the energy transfer from the drop weight assembly to the drive head. Upon reaching a certain height and/or a certain pressure, or some other threshold parameter, the one or more damper devices become active, in order to further retard the drop weight assembly or the drop tank relative to the drive head, e.g. to avoid any mechanical impact type energy transfer that would generate undue noise.

For example, the one or more liquid damper devices are designed to absorb at least 10% of the potential energy of the drop weight assembly or the drop tank. The capacity may be greater when desired.

In an embodiment, the energy transfer assembly comprises multiple integrated spring and damper devices, e.g. said multiple integrated spring and damper devices being arranged in an array, e.g. on a circle, on the drive head member or on the drop weight assembly or or the drop tank or connected between the drive head member and the drop weight assembly or the drop tank.

In an embodiment, the energy transfer assembly comprises multiple energy transfer devices, e.g. spring and/or damper devices, e.g. integrated spring and damper devices, arranged in a circular or annular array so as to act between the drive head member and the drop weight assembly or the drop tank. In embodiments the mean diameter of the array is at least 70% of the diameter of the pile to be driven into the soil, e.g. between 0.7 and 2 times the diameter of the pile.

Generally, it is considered advantageous to have the energy transfer vertically aligned with the wall of the pile, so as avoid the need for an unduly strong head member to transfer the piling forces to the pile top.

In embodiments use is made of a drive head member of which a lower portion is embodied as an exchangeable pile top adapter part and of which an upper portion supports multiple energy transfer devices, e.g. spring and/or damper devices, e.g. integrated spring and damper devices, arranged in a circular or annular array so as to act between the drive head member and the drop weight assembly or the drop tank. The pile top adapter part is configured to mate with a selected pile top diameter, e.g. a series of different diameter pile top adapter parts being provided. Herein, preferably, said series different diameter pile top adapter parts are each embodied to mate with one and the same upper portion of the drive head member. For example, the method comprises selecting an adapter part suited to the diameter of the pile top of the pile to be driven into the soil and mating said selected adapter part with the upper portion of the drive head member.

For example, an exchangeable pile top adapter part comprises a cylindrical sleeve portion configured to be placed about the top end of the pile, and an inward top flange configured to be rested on a flange at the top end of the pile. In an embodiment, an exchangeable pile top adapter part further comprises a section extending above the inward top flange.

In particular embodiments, so-called oleo-pneumatic buffer devices are envisaged as embodiments of the multiple integrated spring and damper devices. Such buffer devices are applied in the railway field since many decades, e.g. between rail carts or as end of track buffer stops. Examples of such oleo-pneumatic spring and damper devices, are for instance shown in GB808931, GB1180466, GB1266596, GB2312659.

For example, as in GB1266596, an integrated spring and damper device may comprises a first and a second liquid filled variable volume chamber separated by a piston structure, wherein the piston structure comprises a bore connecting the two chambers. Upon reaching a certain axial position of the piston structure, a pin secured to the body forming the first chamber enters the bore in the piston structure and therewith defines a throttling orifice for the liquid flow out of the first chamber into the second chamber. The piston structure is extended by a hollow tube in which a further piston is reciprocable and defines the second chamber as well as a gas filled variable volume chamber at the end remote from the second chamber. So the device first mainly acts as a gas spring and then acts as a liquid damper. As explained herein, a forced circulation of damper liquid through a heat exchanger is proposed to cool the liquid in view of the repetitive pile driving cycle.

In an embodiment, each integrated spring and damper device of the energy transfer assembly comprises a compressible gas filled variable volume chamber and each integrated spring and damper device comprises a liquid filled variable volume chamber and an associated liquid flow resistance through which at least a part of said liquid is forced upon compression of the liquid filled variable volume chamber as the drop weight assembly or the drop tank falls.

In an embodiment, the energy transfer assembly comprises multiple liquid damper devices, each comprising a liquid filled variable volume chamber and an associated liquid flow resistance through which at least a part of said liquid is forced upon compression of the liquid filled variable volume chamber by the falling drop weight assembly or the drop tank. Herein the liquid of the multiple liquid damper devices is circulated through a heat exchanger system so as to cool said liquid, e.g. a volume of liquid in the circulation circuit being at least 10 times greater than the volume of the liquid filled variable volume chambers of the multiple liquid damper devices. For example, the heat exchanger is fed with or submerged in seawater for cooling the circulated damper liquid in case the pile is installed into the seabed.

In an embodiment, the energy transfer assembly comprises one or more spring devices and/or one or more damper devices, that are effective between the drop weight assembly or the drop tank and the drive head member. Herein the one or more spring devices and/or one or more damper devices are cooled, e.g. by a liquid coolant, e.g. cooling water, e.g. seawater. The cooling liquid is circulated through or along external wall portions of the one or more spring devices and/or one or more damper devices and/or cooling liquid, e.g. water, being sprayed on external wall portions of the one or more spring devices and/or one or more damper devices.

In an embodiment, the energy transfer assembly comprises multiple liquid damper devices, each comprising a liquid filled variable volume chamber and an associated liquid flow resistance through which at least a part of said liquid is forced upon compression of the liquid filled variable volume chamber by the falling drop weight assembly or drop tank. Herein the liquid of the multiple liquid damper devices is circulated through a heat exchanger system so as to cool said liquid, e.g. a volume of liquid in the circulation circuit being at least 10 times greater than the volume of the liquid filled variable volume chambers of the multiple liquid damper devices, e.g. the heat exchanger being fed with seawater for cooling the circulated damper liquid in case the pile is installed into the seabed.

In an embodiment, the pile driving system comprises a vertical guide structure that is configured to vertically guide the drop weight assembly or the drop tank relative to the drive head. For example, the system includes a telescoping guide member that is vertically guided relative to the drive head. In a practical embodiment, a telescoping guide member comprises an annular guide member surrounding the drive head and having a section protruding above the drive head.

In an embodiment, the one or more spring devices and/or one or more damper devices, e.g. embodied as integrated spring and damper device, are arranged on the drive head member each engaging at a lower end thereof the drive head and each engaging at an upper end thereof the telescoping guide structure.

In an embodiment, the pile driving system comprises a telescoping guide member that is vertically guided relative to the drive head, the telescoping guide member comprising an annular guide member surrounding the drive head and having a section protruding above the drive head, wherein an array of multiple spring devices and of multiple damper devices, e.g. embodied as multiple integrated spring and damper devices, is arranged within the annular guide member.

In an embodiment, the lift mechanism for lifting the drop weight assembly or the drop tank comprises multiple hydraulic lift cylinders. Herein, preferably, the quick release system comprises one or more quick release valves that are opened to allow rapid discharge of hydraulic liquid from the lift cylinders. As explained in U.S. Pat. No. 4,817,733 a lift cylinder can be controlled, in an embodiment, to reverse or retract so fast that the drive part of the cylinder can no longer be caught up by the drop weight.

In an embodiment, the lift mechanism comprises multiple hydraulic lift cylinders, wherein the hydraulic liquid of the multiple lift cylinders is circulated through a heat exchanger system so as to cool the hydraulic liquid, e.g. said heat exchanger being fed with and/or submerged in seawater for cooling the circulated hydraulic liquid in case the pile is installed into the seabed.

It will be appreciated that many alternative designs of the lift mechanism are possible, e.g. using a rack-and-pinion lift mechanism to lift the drop weight assembly or the drop tank, e.g. with some mechanical quick release between the drop weight assembly or the drop tank and the rack and pinion lift mechanism. In another design the drop weight assembly or the drop tank is lifted by one or more winches that drive one or more cables from which the drop weight assembly or the drop tank is suspended, e.g. relative to the drive head or from a crane or similar structure, e.g. a crane or similar structure aboard a vessel. In embodiments a mechanical quick release is present between the drop weight assembly or the drop tank and the one or more winch driven cables, e.g. between the drop weight assembly or the drop tank and one or more sheave blocks suspended from the one or more cables.

In an embodiment, the lift mechanism is integrated with the one or more spring devices and/or the one or more damper devices, wherein said one or more spring devices and/or one or more damper devices are first operated to lift the drop weight assembly or the drop tank into its initial height position and then operated to perform their spring and/or damping functionality upon dropping of the drop weight assembly or the drop tank.

For example, the system comprises a mechanical latch and associated quick release mechanism to maintain the drop weight assembly in its raised initial height position and release the drop weight assembly or the drop tank upon operation of the quick release mechanism. For example, one or more latch pins or the like are provided, each being retractable into a release position by an associated release actuator.

In an embodiment, the pile driving system further comprises one or more telescoping fuel combustion operated devices arranged to be effective between the drop tank or the drop weight assembly and the drive head and, in operation, providing a fuel combustion based blow onto the drive head in addition to the energy transferred from the falling drop tank or drop weight assembly. In practical embodiments the pile driving device comprises a telescoping fuel combustion operated device having a first combustion chamber member mounted to the drive head, and a second combustion chamber member mounted to the drop tank or drop weight assembly, the first and second combustion chamber member being vertically telescoping relative to one another. A supply of fuel and air, or of a fuel/air mixture are envisaged as well as an igniter to ignite the fuel/air mixture in the telescopic combustion chamber. As a result of ignition the fuel/air mixture will combust, preferably very fast as a sort of detonation. The sudden increase of pressure in the chamber causes an impulse downward on the pile, as the upward resultant is absorbed by the mass of the drop tank or the drop weight assembly. In embodiments ignition is timed just before, during, or just after the falling of the drop tank or the drop weight assembly.

In embodiments with one or more telescoping fuel combustion operated devices as indicated above the energy transfer onto the pile can be shaped even more than with just the provision of the drop tank or of the drop weight assembly. For example the ignition, as well as the combustive power of the fuel/air mixture, can be adjusted to obtain first a short impulse onto the pile, followed by a longer duration transfer of energy from the falling drop tank or drop weight assembly (which may have been released right at the moment of ignition or at another suitable moment in view of the desired profile of the force onto the pile by the pile driving system).

In embodiments, combustion gas can readily leave the telescopic chamber via one or more vent openings, possibly a vent opening being permanently present between the first and second combustion chamber members. In an embodiment venting of combustion gas from the combustion chamber is controlled by a controllable vent valve. The latter may, in embodiments, allow for keeping the combustion chamber in an enclosed telescopic combustion chamber member for a while after ignition, e.g. so that the combustion gas acts as a gas cushion for the falling drop tank or drop weight assembly.

In embodiments, it is envisaged that the power of the combustion is selected such that the drop tank is not lifted due to the combustion. As indicated above, ignition may be timed to occur during the actual fall of the drop tank or drop weight assembly, e.g. during the falling drop tank or drop weight assembly already interacting with the associated spring devices and/or damper devices.

For example, the fuel is diesel.

For example, multiple telescoping fuel combustion operated devices are provided with igniters that are synchronized to ignite the mixture in all combustion chambers at the same time.

In an embodiment of the method according to the invention, at least once the pile has reached its desired depth into the soil, the drop weight assembly or the drop tank is set to a mass so as to achieve a vertical load on the pile that is at least equal to the load of the structure that the pile is designed to support, e.g. at least equal to the weight of an offshore wind turbine in case the pile is a monopile foundation for such an offshore wind turbine. This amounts to a 100% load testing of the installed pile, which is usually impossible using existing piling system and design pile loads, in particular for any design pile load of more than 500 tonnes.

In an embodiment, the pile is a monopile foundation for an offshore wind turbine, wherein the method may be followed by installation of the offshore wind turbine.

The invention also relates to a method for installation of an onshore or offshore wind turbine wherein a monopile wind turbine foundation is driven into the seabed or on land soil as discussed herein, followed by a later installation of the wind turbine on the monopile foundation, e.g. with an intermediate transition piece as is known in the art.

The present invention also relates to a pile driving system as disclosed herein.

The present invention also relates to a drop weight assembly as disclosed herein.

The present invention also relates to a pile driving system.

The present invention also relates to the use of a pile driving system according to the invention for driving a pile, e.g. a hollow and open ended pile, e.g. a large diameter pile having an outer diameter of at least 5 meters, e.g. a monopile of an offshore wind turbine, into the soil, e.g. into the seabed.

The present invention also relates to the installation of a monopile foundation of an offshore wind turbine wherein use is made of a pile driving system according to the invention.

The present invention also relates to a marine vessel, e.g. a jack-up marine vessel, provided with a pile driving system according to the invention.

BRIEF DESCRIPTION OF THE DRAWINGS

In the drawing:

FIG. 11*b* shows a detail of the of FIG. 11*a*, FIGS. 12*a, b* show the pile driving system of FIG. 4 during various stages of operation.

DETAILED DESCRIPTION OF EMBODIMENTS

Figure 1:
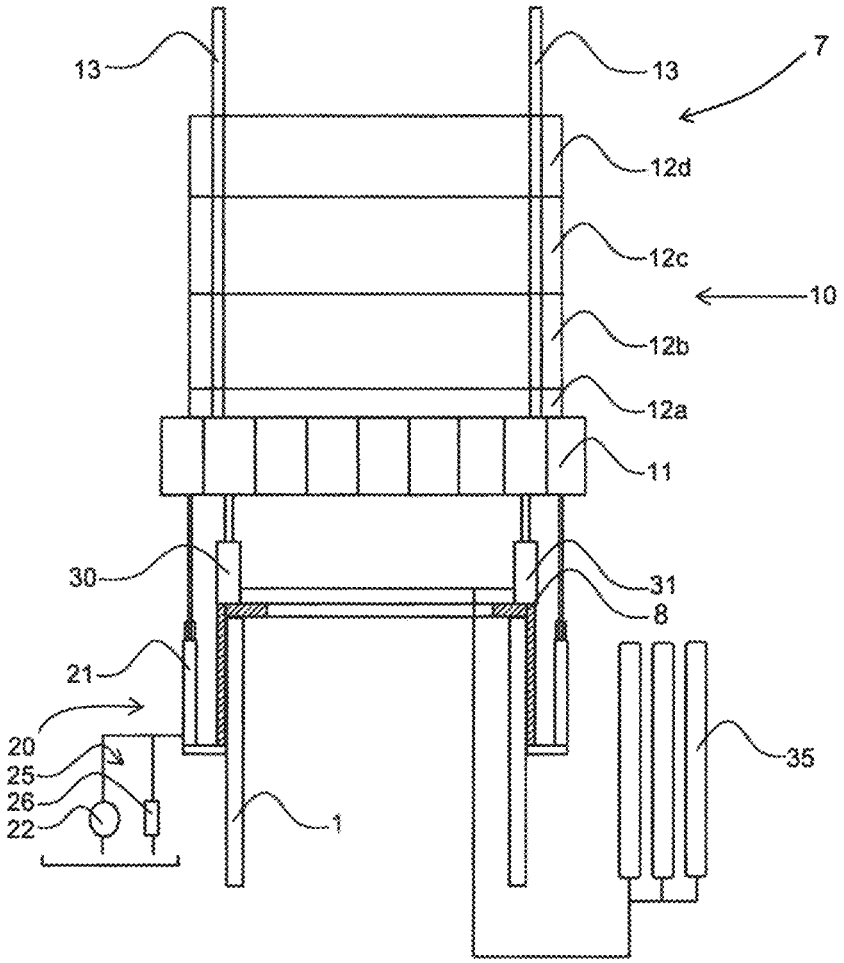
FIG. 1 shows schematically and not to scale, an example a pile driving system according to the first aspect of the invention in a pile driving method for driving a pile, e.g. a hollow and open ended pile.

In FIG. 1 it is schematically shown that a pile, e.g. a hollow and open ended pile, e.g. a large diameter hollow and open ended pile 1, of which only a top is shown, having an outer diameter of at least 5 meters, e.g. a monopile of a wind turbine, is driven into the soil, e.g. into the seabed by means of a pile driving system 7 according to the invention.

Figure 2:
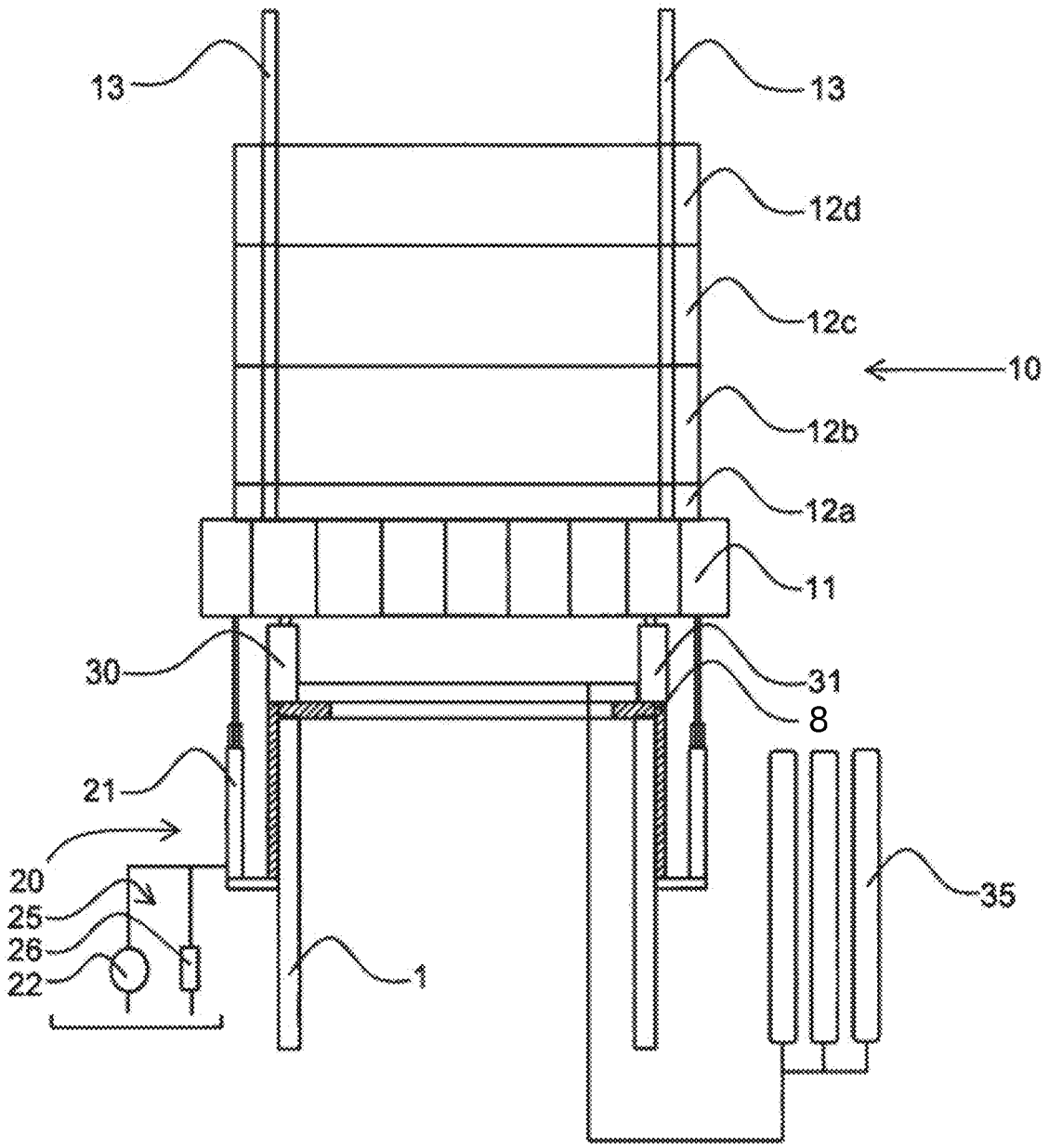
FIG. 2 shows the system of FIG. 1 after the solid mass drop weight assembly has been allowed to fall from the initial position thereof.

In FIG. 1 the drop weight assembly 10 of the pile driving system 7 is in the initial height position thereof relative to the drive head member 8. In FIG. 2 that drop weight assembly 10 is at the end of the vertical fall, after the quick release system 25 has been operated and the assembly 10 has fallen due to gravity.

The pile driving system 7 comprises:

- a drive head member 8 that is configured to engage the pile, e.g. is configured to be arranged on the top end of the pile 1,
- a drop weight assembly 10 that is vertically mobile relative to, here above, the drive head member 8,
- a lift system 20 arranged between the drive head member 8 and the drop weight assembly 10, that is configured to bring the drop weight assembly 10 into an initial height position relative to the drive head member 8,
- a quick release system 25 that is adapted to effect quick release of the lift system so that the drop weight assembly falls down from said initial height position,
- an energy transfer assembly 30 configured for transfer of energy from the falling drop weight assembly 10 to the drive head member 8.

The drive head member 8 may have a mass of at least 100 tonnes, e.g. at least 250 tonnes, e.g. of more than 500 tonnes.

The solid mass drop weight assembly comprises a support structure 11 and comprises multiple solid drop weight elements 12*a-d* that are supported by the support structure 11.

The support structure 11 may be construed with a platform on which the weight elements 12*a-d* are stacked.

The support structure 11 or the drive head member 8 may be provided with vertical guide members 14, here for pylons 13, therein.

The vertical guide members 14 may be configured and used as guides during stacking and destacking of solid drop weight elements 12*a-d*. For example, the guide members 14 are configured to interact with a lifting tool 6 of a crane 4 that is used in said stacking and destacking of the elements 12, so that the tool is guided by said guide members.

In a practical embodiment, the drop weight is composed of stackable steel elements, e.g. planar steel elements, that are stacked on the support structure between the pylons.

For example, four pylons 13 are arranged in a rectangular grid on the support structure 11 or on the drive head member 8. For example, elongated steel plates are stacked between the four pylons.

Figure 7:
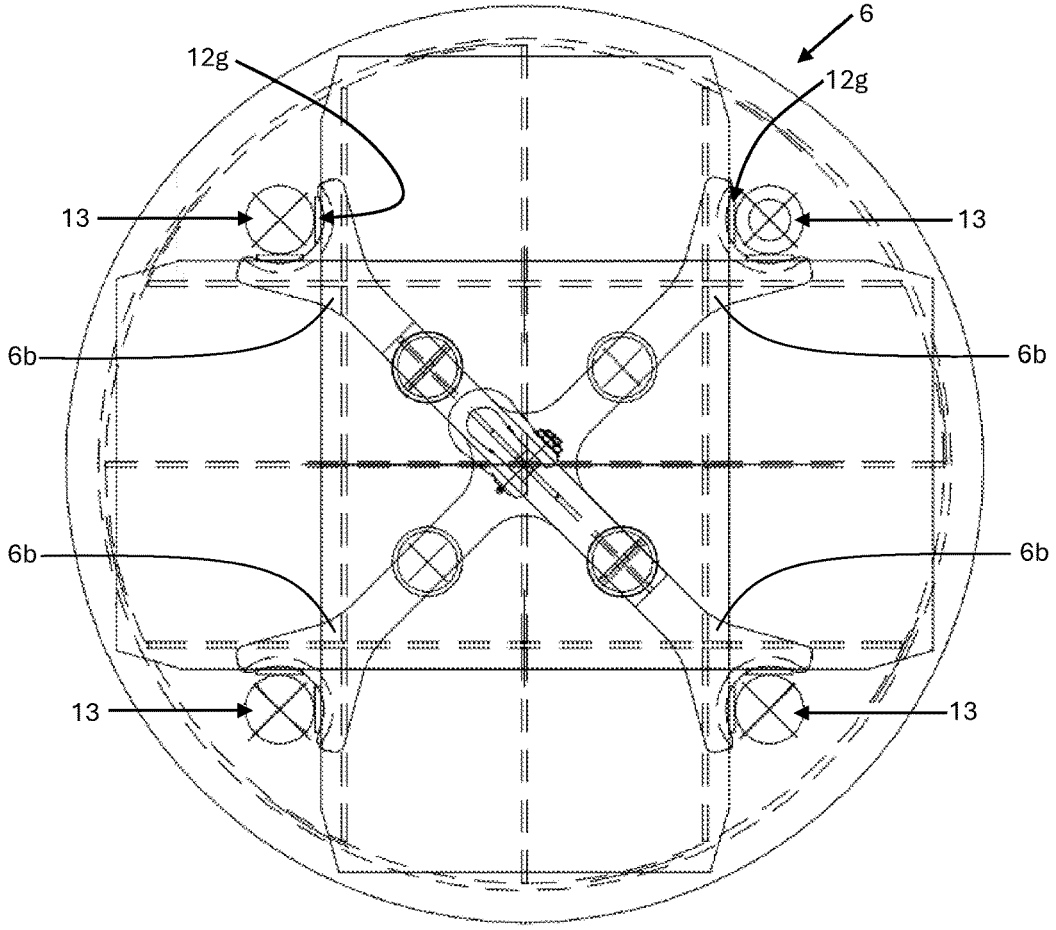
FIG. 7 shows a view from above onto the pile driving system of FIG. 4.

For example, as shown in FIG. 7, each solid steel drop weight elements 12*a-d* may have one or more slide pad members 12*g* configured for sliding engagement with a vertical guide member, e.g. pylon 13.

As preferred, the elements 12*a-d* are solid steel drop weight elements being composed of steel elements, here stackable steel elements. During pile driving the drop weight elements have a total mass of at least 100 tonnes, e.g. more than 500 tonnes, e.g. more than 1000 tonnes, e.g. more than 2000 tonnes.

As explained herein, for driving the pile 1 into the soil, the drop weight assembly 10 is arranged to have a desired mass, which is here achieved by stacking a desired number of steel elements 12*a-d* on the support structure 11.

The method comprising a repeated cycle wherein:

- the drop weight assembly 10 is lifted by means of the lift system 20 into a desired initial height position,
- the quick release system 25 is operated to effect quick release of the lift system so that the drop weight assembly 10 falls down from said initial height position towards the drive head member due to gravity.

Herein energy from the drop weight assembly 10 is transferred by the energy transfer assembly 30 to the drive head member 8 and thereby to the pile 1, here to the top end of the pile, so that the pile 1 is driven deeper into the soil. This cycle is repeated till the desired penetration depth is reached.

As explained it is envisaged that the energy transfer from the drop weight assembly 10 to the pile drive head member 8 is devoid of mechanical impact energy transfer between the drop weight assembly 10 and drive head member 8. As shown here the energy transfer assembly is devoid of an anvil.

The energy transfer assembly 30 comprises one or more spring devices and/or one or more damper devices, e.g. embodied like the mentioned oleo-pneumatic integrated spring and damper devices. These devices are here mounted on the drive head member 8 in a circular or other shaped array and are effective between the drop weight assembly and the drive head member.

The pile 1 here has an open foot end and an outer diameter of at least 5 meter, e.g. of between 5 and 12 meters. Preferably, the pile 1 is hollow over its length.

For example, the pile 1 has a length of 80 meters or more, e.g. over 100 meters.

For example, the pile 1 has a mass of 800 tonnes or more, e.g. over 1000 tonnes. As explained herein, the total mass of the drop weight assembly can be of similar magnitude or even greater.

In embodiments, the energy transfer assembly 30 comprises multiple gas spring devices, e.g. telescopic devices, each comprising a compressible gas filled variable volume chamber that is compressed with resultant increase of gas pressure upon compression of the liquid filled variable volume chamber by the falling drop weight assembly.

In embodiments, the energy transfer assembly 30 comprises multiple liquid damper devices, e.g. telescopic devices, each comprising a liquid filled variable volume chamber and an associated liquid flow resistance through which at least a part of said liquid is forced upon compression of the liquid filled variable volume chamber by the falling drop weight assembly.

It is illustrated here that the energy transfer assembly 30 comprises multiple integrated spring and damper devices 31, these multiple integrated spring and damper devices 31 being arranged in a circular array on the drive head member 8. These devices are vertically telescopic to form one or more chambers for gas and for damping liquid. Instead of, or in combination with, damping using liquid damping other damping devices can be applied, e.g. based on mechanical friction.

As explained, each integrated spring and damper device 31 may comprise a compressible gas filled variable volume chamber that is reduced in volume by the falling drop weight assembly and each integrated spring and damper device comprises a liquid filled variable volume chamber and an associated liquid flow resistance through which at least a part of said liquid is forced upon compression of the liquid filled variable volume chamber by the falling drop weight assembly.

The energy transfer assembly 30 may comprise one or more pressurized gas storage vessels 35, that are in communication with the compressible gas filled variable volume chambers.

In embodiments, a vertical guide structure is provided that is configured to vertically guide the drop weight assembly 10 relative to the drive head member 8. For example, a telescoping guide member is provided. For example, the telescoping guide member comprises an annular guide member surrounding the drive head member and having a section protruding above the drive head.

It is illustrated that the one or more spring devices and/or one or more damper devices, e.g. embodied as integrated spring and damper devices 31, are arranged on the drive head member 4, each device 31 engaging at a lower end thereof the drive head member 8 and each engaging at an upper end thereof the structure 11, e.g. being connected thereto.

It is illustrated here that an array of multiple spring devices and of multiple damper devices, e.g. embodied as multiple integrated spring and damper devices 31, is arranged.

As preferred, the lift system 20 comprises multiple hydraulic lift cylinders 21 and an associated hydraulic pump 22. The quick release system 25 comprises one or more quick release valves 26 that are opened to allow rapid discharge of hydraulic liquid from the lift cylinders. As preferred, the hydraulic liquid of the one or more lift cylinders 21 is circulated through a heat exchanger system so as to cool the hydraulic liquid, e.g. said heat exchanger being fed with seawater for cooling the circulated hydraulic liquid in case the pile is installed into the seabed.

As preferred, the liquid of the multiple liquid damper devices 31 is circulated through a heat exchanger system so as to cool said liquid, e.g. a volume of liquid in the circulation circuit being at least 10 times greater than the volume of the liquid filled variable volume chambers of the multiple liquid damper devices, e.g. the heat exchanger being fed with seawater for cooling the circulated damper liquid in case the pile is installed into the seabed.

Figure 3:
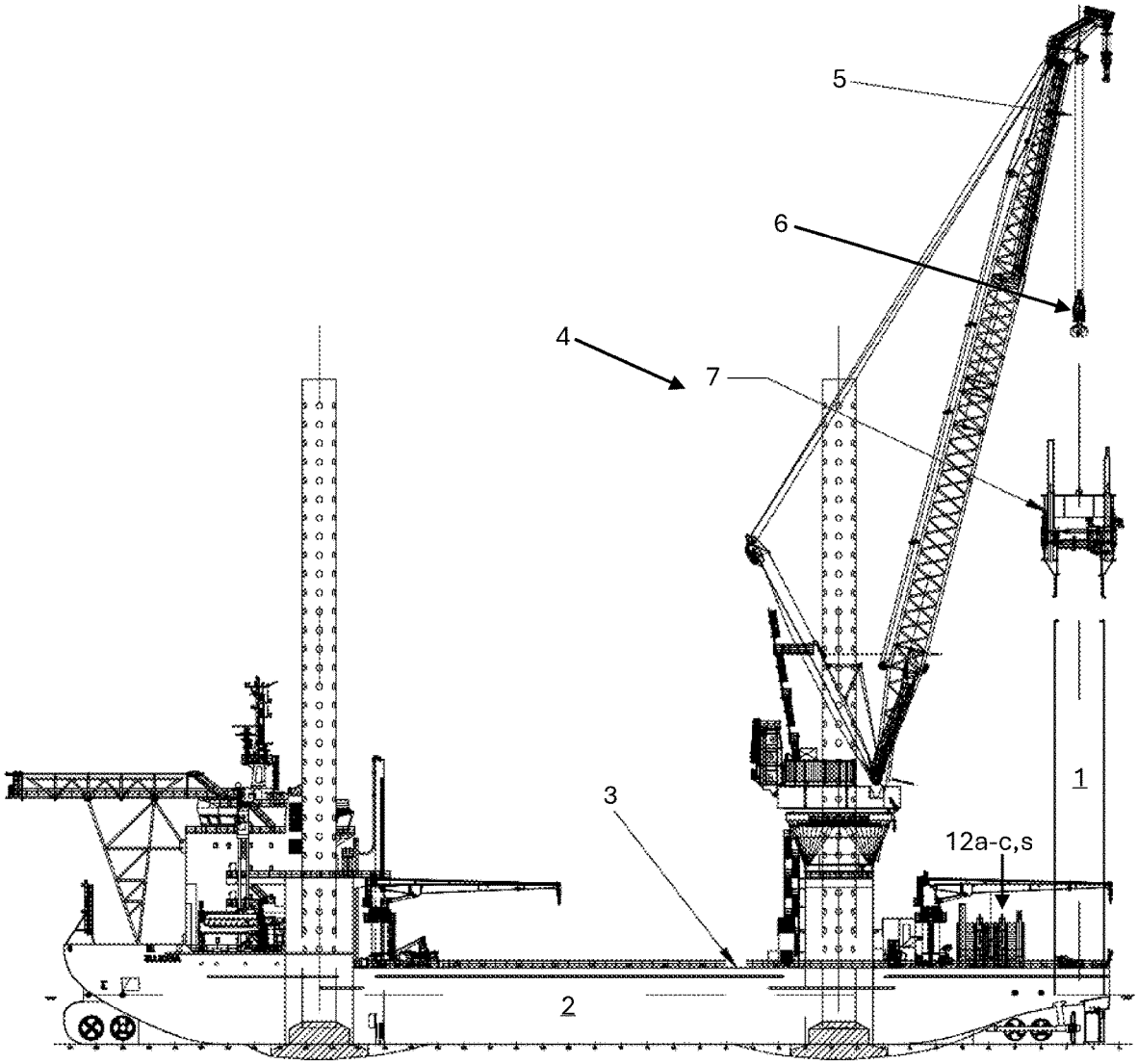
FIG. 3 shows a jack-up marine vessel provided with a crane and pile driving system according to the invention, as well as a monopile to be driven into the seabed.

In FIG. 3 a marine vessel 2, here a jack-up marine vessel, with a deck 3 and a crane 4 is shown. The crane 4 comprises a hoist assembly 5 and is revolvable about a vertical axis. The crane 4 has a boom which is pivotable over a horizontal axis by employing a luffing mechanism. An embodiment of the pile driving system 7 according to the invention is also shown above a pile 1 to be driven into the soil.

Solid drop weight elements 12*s*, and 12*a-c* of this pile driving system 7 are stored in a storage position thereof on the deck 3.

This pile 1 is e.g. a hollow and open ended pile, e.g. a large diameter hollow and open ended pile 1 having an outer diameter of at least 5 meters, e.g. a monopile of a wind turbine, is driven into the soil, e.g. into the seabed by means of a pile driving system 7 according to the invention.

The marine vessel 2 further comprises a lifting tool 6 configured to engage, retain and release both a set of solid drop weight elements 12*s* and 12*a-c*, and the pile driving system 7.

The tool 6 is configured to be suspended from the hoist assembly 5, so that the crane 4 is able to move the pile driving system 7 between a storage position thereof, e.g. on the deck 3 of the vessel 2, and a pile driving position thereof in which it is arranged on the top end of the pile 1 such as to engage said top end, and to move a set of solid drop weight elements 12*s*, 12*a-c* between the drop weight assembly 10 between a storage position thereof, e.g. on the deck 3 of the vessel 2 as shown, and a functional position thereof in which the set of solid drop weight elements is stacked onto the support structure 11 of the pile driving system 7.

As preferred, the tool 6 has one or more, here four in a cross arrangement, positioning arms 6*b* that are configured to be brought into contact with a respective vertical guide member or pylon 13. This allows to orient the tool 6 relative to the drop weight elements, e.g. to allow one or more mobile pins 6*a* to engage in respective holes in connectors 11*n*. This is shown in detail in FIG. 11*b*.

Figure 4:
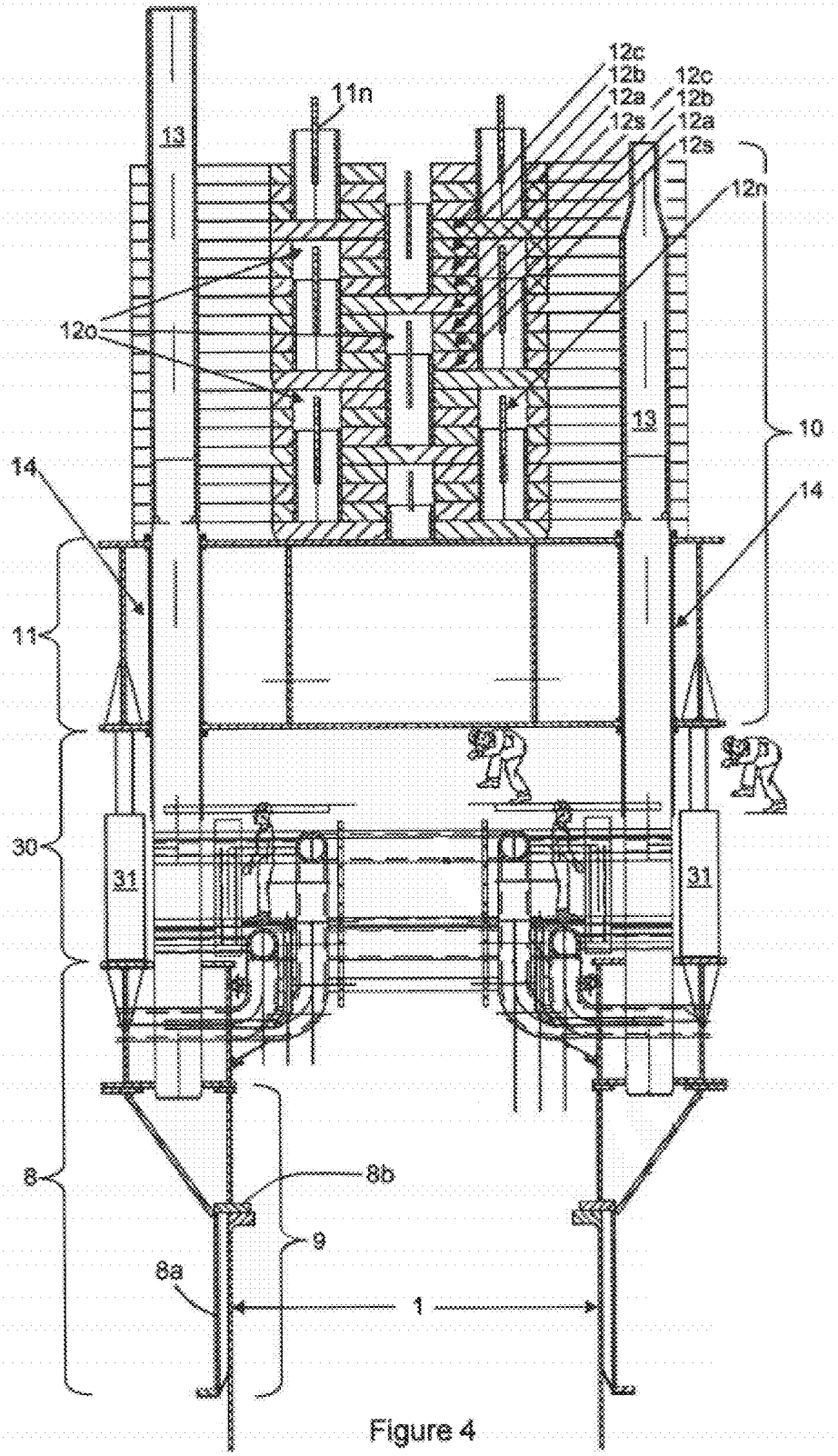
FIG. 4 shows in cross-section, schematically, a pile driving system according to the according to the first aspect of the invention, wherein the exchangeable drive head member adapter part is configured to engage a relatively smaller diameter pile.
Figure 5:
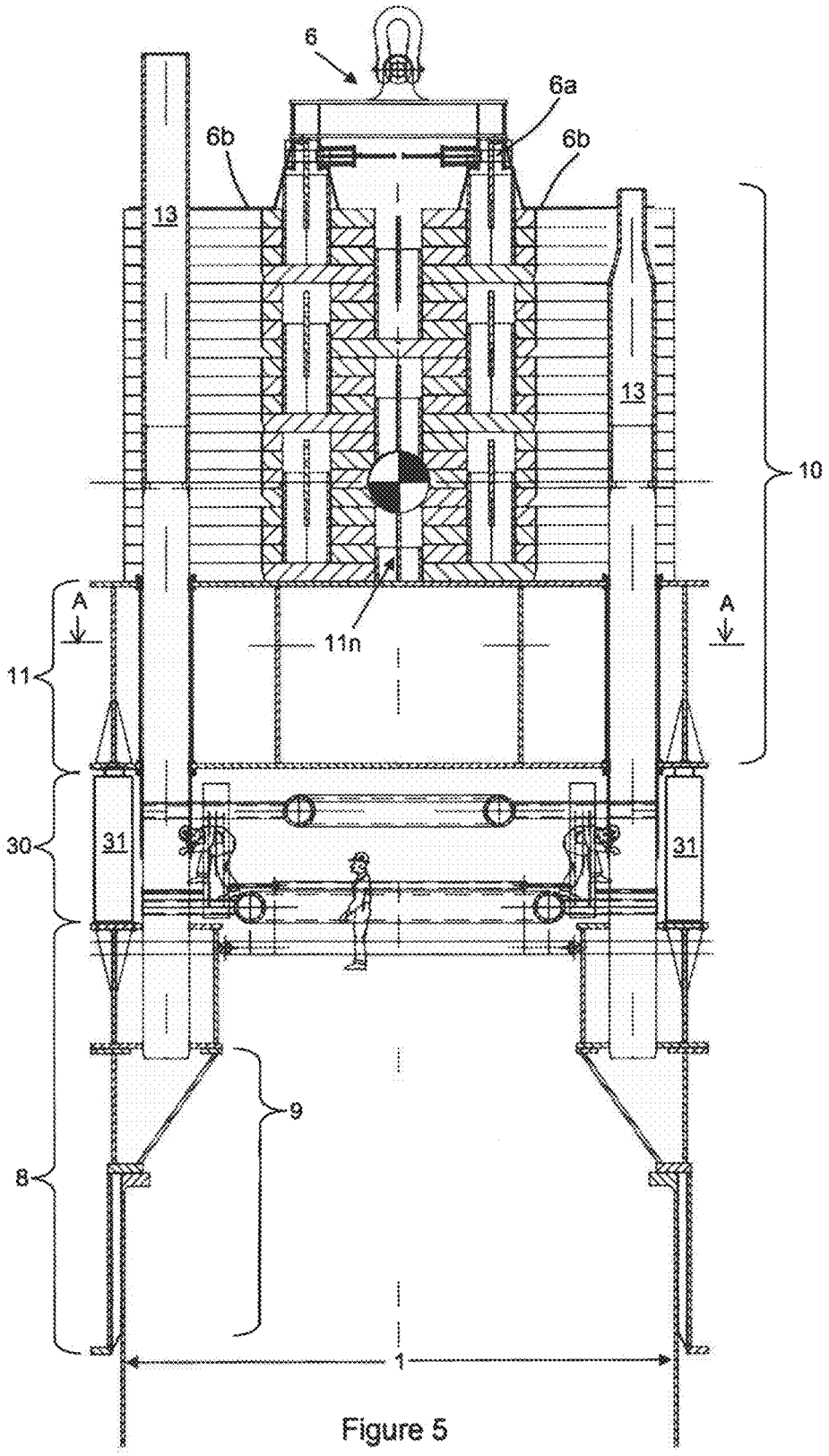
FIG. 5 shows the pile driving system of FIG. 4, wherein the exchangeable drive head member adapter part is configured to engage a relatively larger diameter pile.

FIGS. 4 and 5 illustrate a vertical cross-section of embodiments of the pile driving system 7.

The drive head member 8 is arranged on and engages the top end of the pile 1. As explained the drive head member 8 comprises an exchangeable pile top adapter part with a cylindrical sleeve portion 8*a* that is configured to be placed about the top end of the pile and an inward top flange 8*b* that is configured to be rested on a flange at the top end of the pile. The exchangeable pile top adapter part further comprises a section extending above the inward top flange 8*b*.

In FIGS. 4 and 5, the same features as discussed for the schematic FIGS. 1 and 2 may be recognized.

Figure 6:
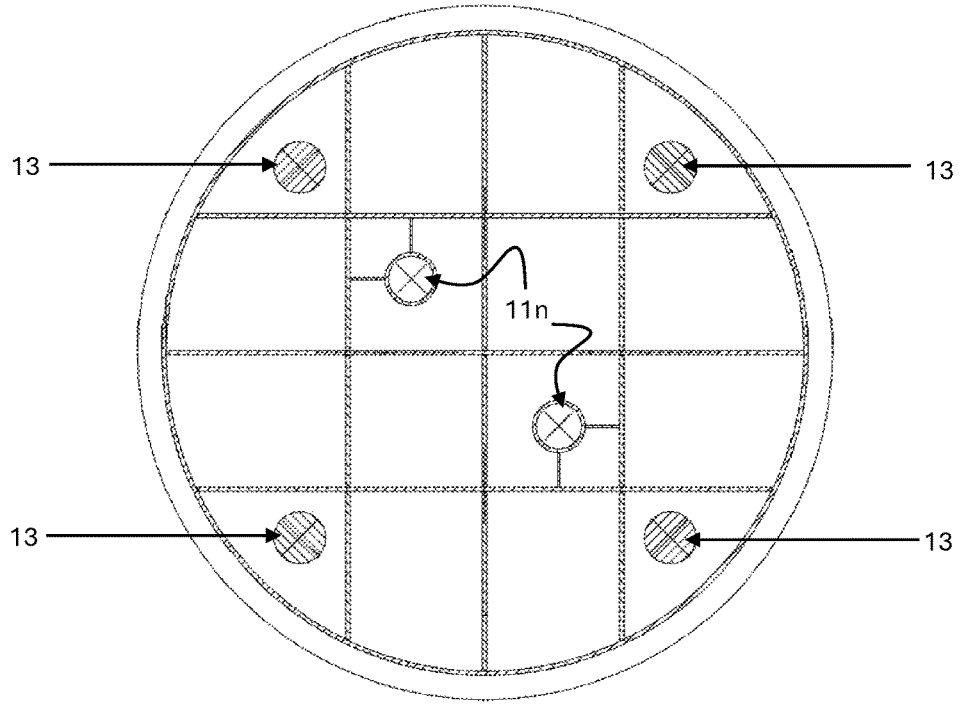
FIG. 6 shows cross-section A-A of the embodiments of FIGS. 4 and 5.

FIG. 6 shows the cross-section A-A of the embodiments of FIGS. 4 and 5, the location of the cross-section A-A being indicated in FIG. 5.

It is illustrated that the pile driving system 7 comprises:

- the drive head member 8 that is configured to be arranged on the top end of the pile 1 such as to engage the pile,
- a drop weight assembly 10 that is vertically mobile relative to, here above, the drive head member 8,
- a lift system 20, arranged between the drive head member 4 and the drop weight assembly 10, that is configured to bring the drop weight assembly into an initial height position relative to the drive head member 8,
- a quick release system 25 that is adapted to effect quick release of the lift system so that the drop weight assembly falls down from said initial height position,
- an energy transfer assembly 30 configured for transfer of energy from the falling drop weight assembly 10 to the drive head member 8.

The drive head member 8 comprises an exchangeable adapter part 9, which in the embodiment of FIG. 4 is configured to engage a relatively small diameter pile 1, here in the on scale Figure of about 6 meters diameter, and which in the embodiment of FIG. 5 configured to engage a relatively larger diameter pile, here in the on scale Figure of about 9 meters diameter.

In FIG. 4, the pile driving system 7 is shown while the drop weight assembly 10 of the pile driving system 7 is in the initial height position thereof relative to the drive head member 8. In FIG. 5 the drop weight assembly 10 is at the end of the vertical fall, after the quick release system has been operated and the assembly 10 has fallen due to gravity only, so absent any acceleration mechanism.

The solid mass drop weight assembly 10 comprises a support structure 11 and comprises multiple solid drop weight elements 12*s*, 12*a-c* that are supported by the support structure 11.

The support structure 11 is construed with a platform on which the weight elements 12*s*, 12*a-d* are stacked.

The support structure 11 or the drive head member 8 is provided with vertical guide members 13, here pylons, thereon, configured and used as guides during stacking and destacking of solid drop weight elements 12*s*, 12*a-c*. The drop weight is composed of stackable planar steel elements 12*s*, 12*a-c* that are stacked on the support structure between the pylons.

As shown here, the multiple pylons 13 can be arranged within the circular array of energy transfer devices 31, which allows to keep the diameter of the system limited.

As best visible from FIG. 6, four pylons 13 are arranged in a rectangular grid on the drive head member 8, here on the upper portion thereof.

The multiple solid drop weight elements are arranged in sets of four solid drop weight elements with a special configuration. In FIGS. 4 and 5, five sets of solid drop weight elements are stacked on the support structure 11. As indicated in FIG. 4, each set comprises a rectangular base drop weight element 12*s*, which comprises multiple vertically protruding parts with each a connector 12*n*, and three rectangular additional drop weight elements 12*a*, 12*b* and 12*c*. The additional drop weight elements 12*a-c* comprise openings 120 which match with the protruding parts, so that they can be placed on top of the base drop weight element 12*s* of a respective set. On top of the uppermost additional drop weight element 12*c* of a first set indicated in FIG. 4, a further, second set of drop weight elements is stacked, but then turned 90° over a vertical axis with respect to the first set. The rest of the stack is built up in the same way. The connectors 12*n* of each base drop weight element 12*s* are connectable to the lifting tool 6.

In FIG. 5, it is shown that the lifting tool 6 engages the connectors 12*n* of the base drop weight element 12*s* of the uppermost set of drop weight elements, so as to place the set on the set below it, or to remove it from the mass drop weight assembly 10. The lifting tool is shown in a top view in FIG. 7.

As explained, for driving the pile 1 into the soil, the drop weight assembly 10 is arranged to have a desired mass, which is here achieved by stacking a desired number of steel elements 12*s*, 12*a-c* on the support structure 11. This is illustrated in FIGS. 9*a*-9*f*, which consecutively show a progression of increasing mass of the drop weight assembly 10 as more sets of solid drop weight elements 12*s*, 12*a-c* are stacked on the support structure 11.

The energy transfer assembly 30 of the pile driving system 7 comprises multiple integrated spring and damper devices 31, these multiple integrated spring and damper devices 31 being arranged in a circular array on the drive head member 8. These devices are vertically telescopic to form one or more chambers for gas and for damping liquid.

As explained, each integrated spring and damper device 31 may comprise a compressible gas filled variable volume chamber that is reduced in volume by the falling drop weight assembly and each integrated spring and damper device comprises a liquid filled variable volume chamber and an associated liquid flow resistance through which at least a part of said liquid is forced upon compression of the liquid filled variable volume chamber by the falling drop weight assembly.

Figure 8:
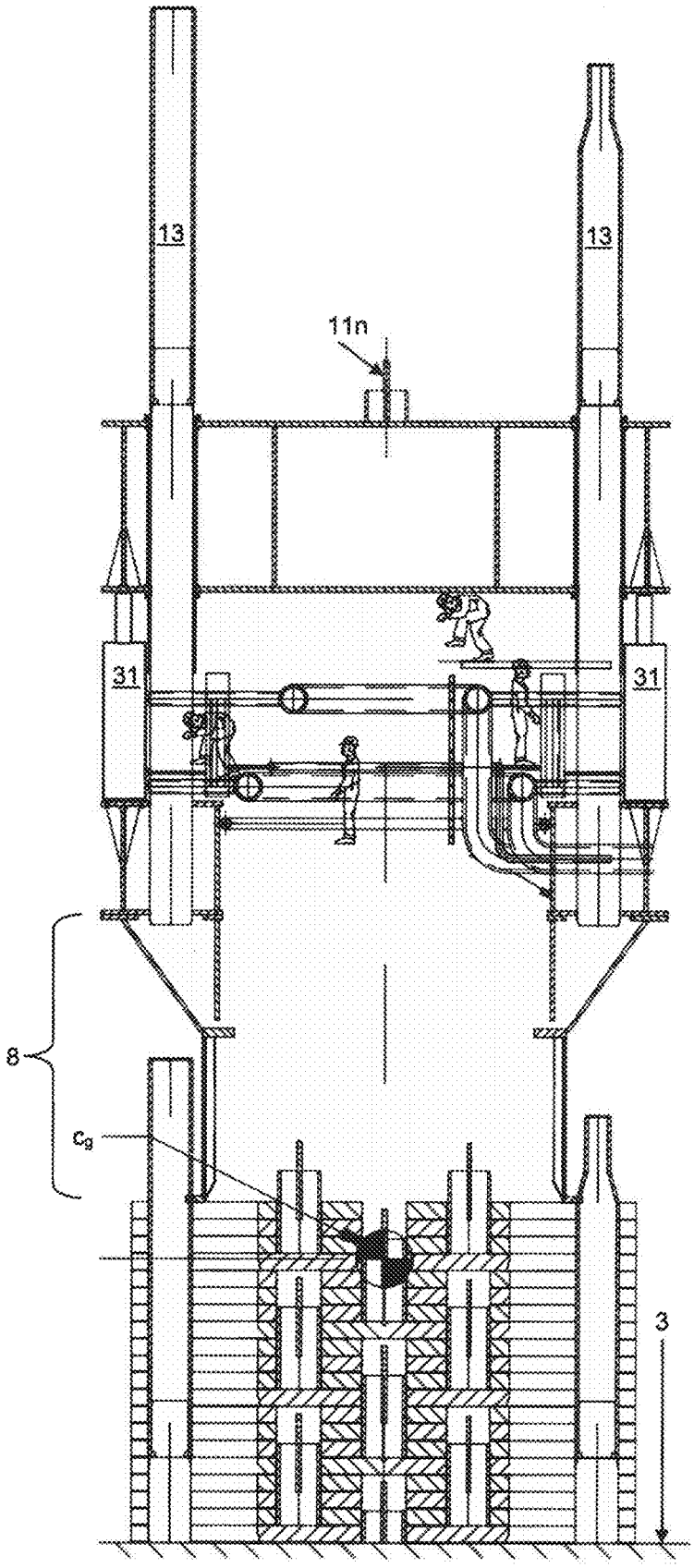
FIG. 8 illustrates the pile driving system of FIG. 4 placed on deck of the vessel.
Figures 9A, 9B, 9C, 9D, 9E, 9F:
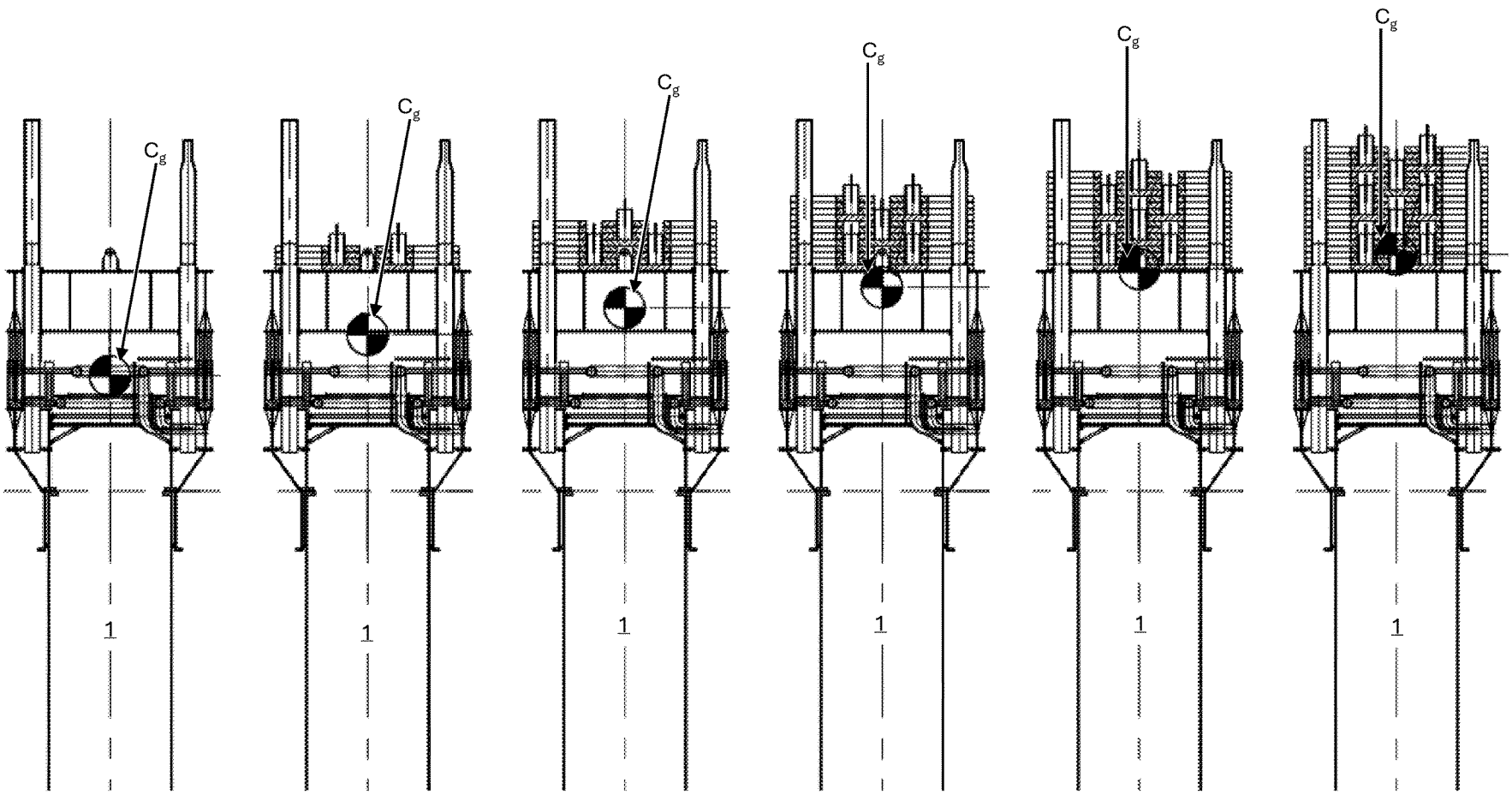
FIGS. 9*a-f* illustrate driving a pile using the pile driving system of FIG. 4.

As shown in FIG. 8, the adapter part 9 and pylons 13 are attuned to each other such that the drive head member 4 may be placed onto a stack of drop weight elements 12*s* and 12*a-c*, which is on top of the deck 3. The drop weight elements are stacked on the deck on top of each other in the same way in between similar pylons as they are to be stacked in between the pylons 13 of the pile driving system 7. The center of gravity $c_g$ of the stack and pile driving system 7 together in this storage configuration, is shown in FIG. 8 as well.

Similar to the base drop weight elements 12*s* comprising the connector 12*n*, the support structure 11 also comprises protruding parts with each a connector 11*n*, which are connectable to the lifting tool 6. This is indicated in FIGS. 5 and 8.

The tool 6 here comprises movable pins 6*a* that are selectively movable into and out of a hole made in connector 11*n*.

Figure 10:
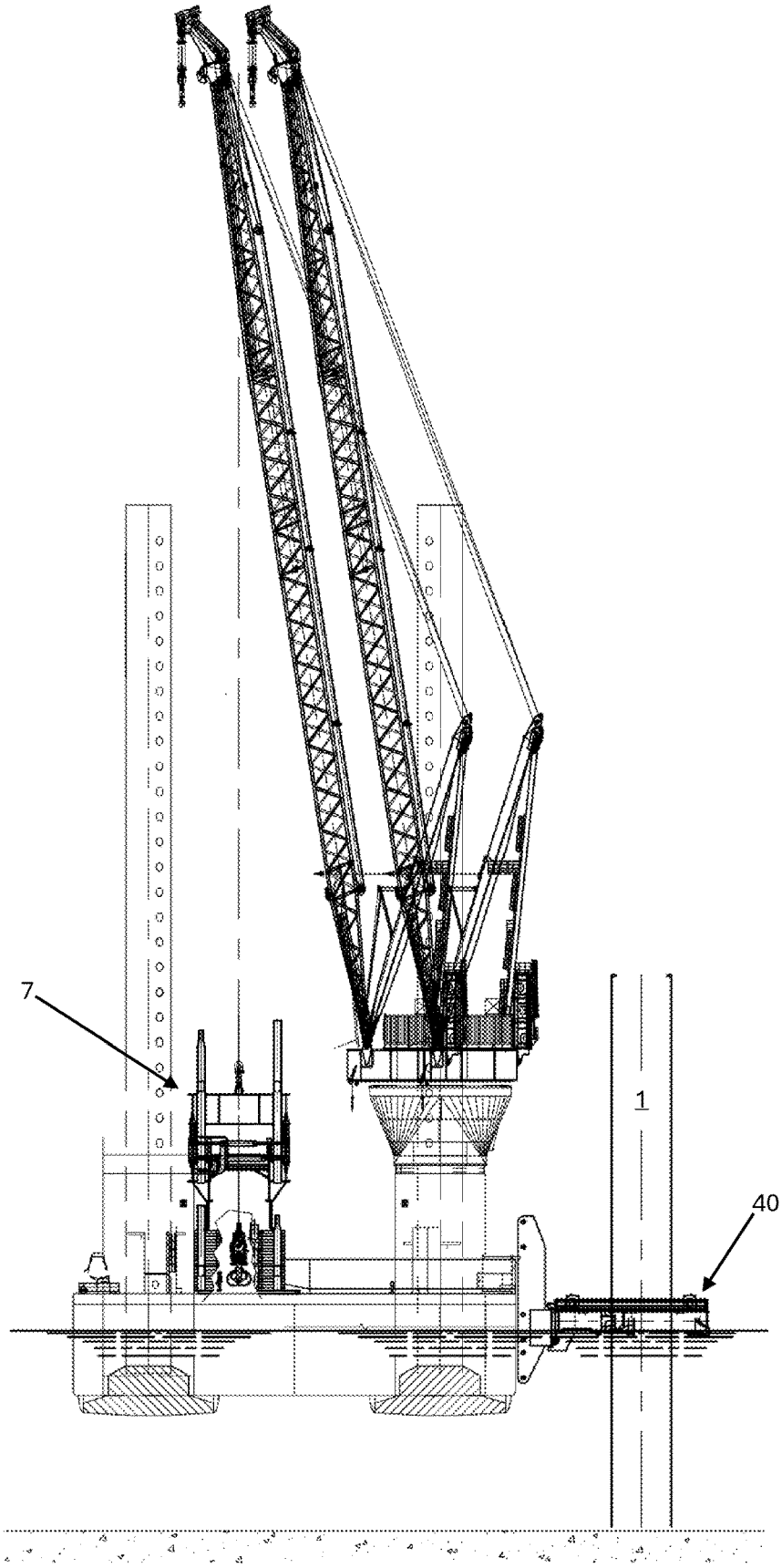
FIG. 10 shows the vessel of FIG. 3 with pile holder holding the pile 1 ahead of pile driving using the pile driving system of FIG. 4.

In a possible method for pile driving, in which the pile driving system 7 is stored in a storage position thereof on the vessel, e.g. on the deck 3, e.g. in the manner shown in FIG. 8, comprises the step of connecting the pile driving system 7 to the lifting tool 6 of the vessel 2 so that the pile driving system 7 can be moved to the pile driving position thereof on the pile 1. This connecting step is illustrated in FIG. 10—therein the pile 1 is being held in place laterally by a pile gripper 40.

Figure 11A:
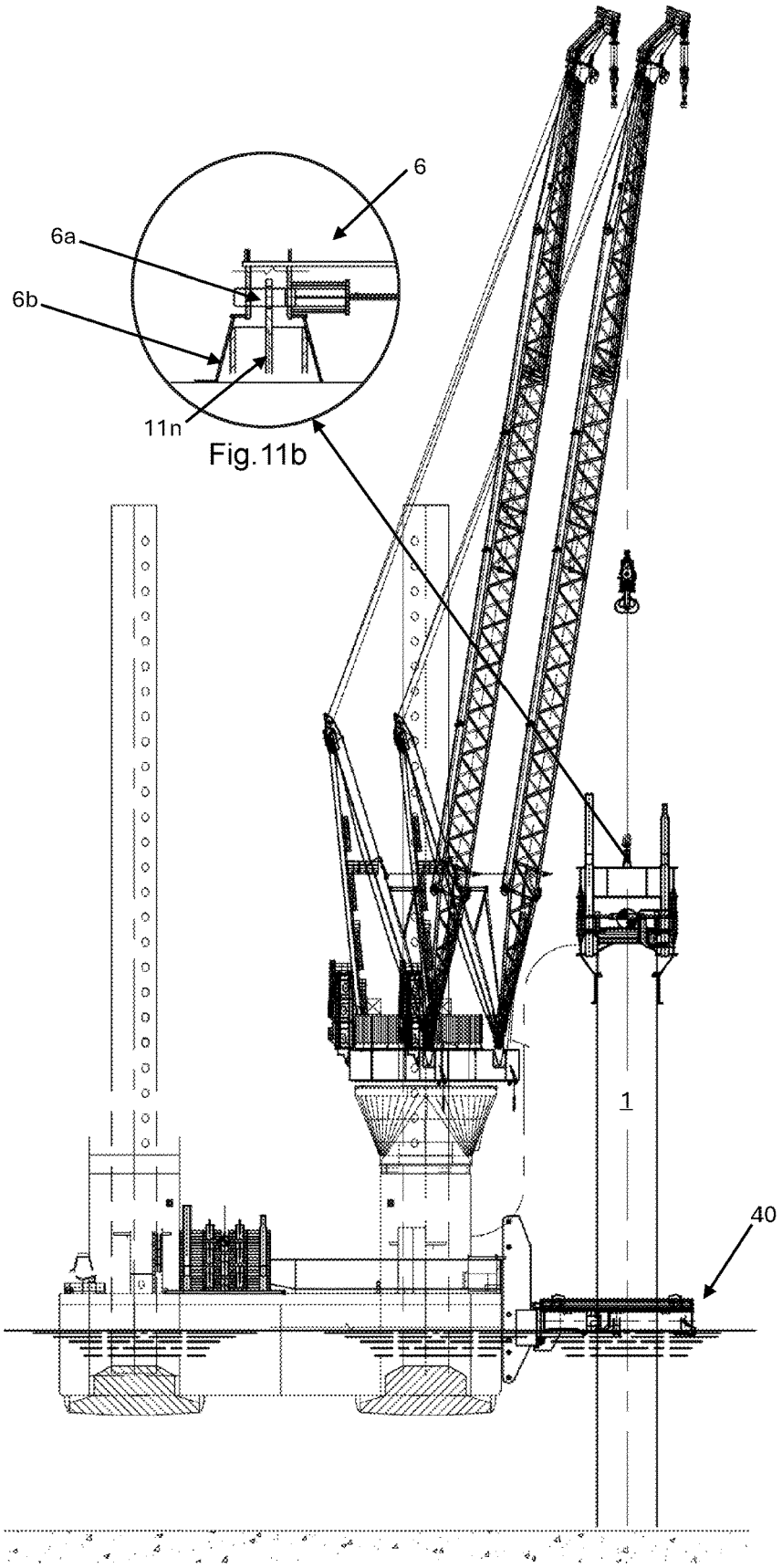
FIG. 11*a* shows the vessel of FIG. 10 with the pile driving system placed on the pile using the crane.

The method comprises the step of employing the crane 4 to move the pile driving system 7 from the storage position thereof, e.g. on the deck 3, to the pile driving position thereof. This pile driving position is shown in FIG. 11*a*. Thereto the lifting tool 6 suspended from the crane 4 is moved such that it approaches the connectors 11*n* of the support structure of the pile driving system 7 in the storage position, after which these are engaged and connected by the lifting tool 6 such as to suspend the pile driving system 7 from the crane 4. This connection is shown in the magnification shown in the left-top part in FIG. 11*b*. The crane 4 then moves, e.g. by revolving the boom around the vertical axis and pivoting it around the horizontal axis, the pile driving system 7 from the storage position into the pile driving position thereof, after which the pile driving system 7 is disconnected from the lifting tool 6.

In a possible method for pile driving, e.g. a method including the abovementioned steps of connecting and moving the pile driving system from the storage position to the pile driving position, the pile 1 is driven into the soil by a repeated cycle. This repeated cycle comprises firstly the step of lifting the drop weight assembly 10 by means of the lift system 20 into a desired initial height position.

Figure 12A:
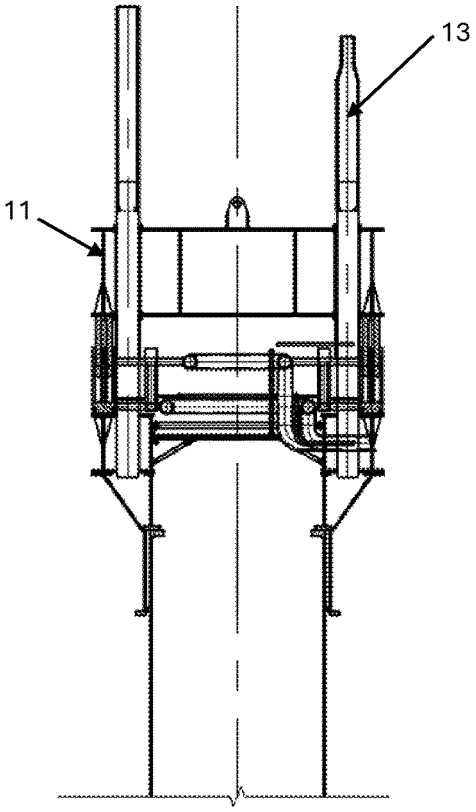
FIG. 12*c* illustrates the lifting tool.
FIG. 12*d* illustrates the lifting tool approaching the uppermost set of drop weight elements in a side view.
FIG. 12*e* illustrates the configuration of FIG. 12*e* in a top view.
FIG. 12*f* illustrates the lifting tool engaging to the uppermost set of drop weight elements.
FIG. 12*g* illustrates the configuration of FIG. 12*f* in a top view.
FIG. 12*h* illustrates the lifting tool connecting to the uppermost set of drop weight elements.
FIG. 12*i* illustrates the configuration of FIG. 12*h* in a top view.

This initial height position of the drop weight assembly 10 is shown in FIG. 12*a*, and in FIG. 4. The repeated cycle comprises secondly the step of operating the quick release system 25 to effect quick release of the lift system 20, so that the drop weight assembly 10 falls down from said initial height position towards the drive head member 8 due to gravity. The final position of the drop weight assembly 10 is shown in FIG. 12*b*, and in FIG. 5.

Figure 12B:
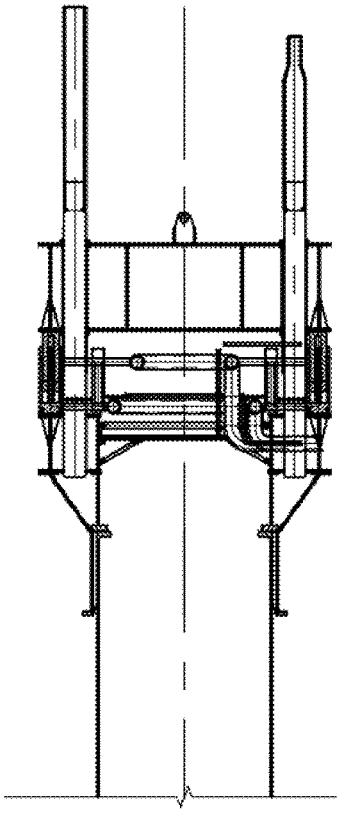

The repeated cycle may be executed without any solid drop weight elements 12*s*, 12*a-c* being stacked on the support structure 11, as in FIGS. 12*a*, 12*b* so that the drop weight assembly consists of the support structure only. The repeated cycle may also be executed with a desired number of sets of solid drop weight elements stacked thereon.

In a possible method for pile driving, the method comprises employing the crane 4 to move sets of drop weight elements 12*a-c*, 12*s* from a storage position thereof, e.g. on the deck 3, as shown in FIGS. 10-13, to the functional position thereof in which the set of solid drop weight elements is stacked onto the support structure 11 of the pile driving system 7, which is in the pile driving position thereof.

Figure 12C:
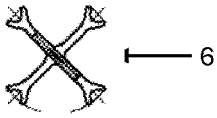
Figure 12D:
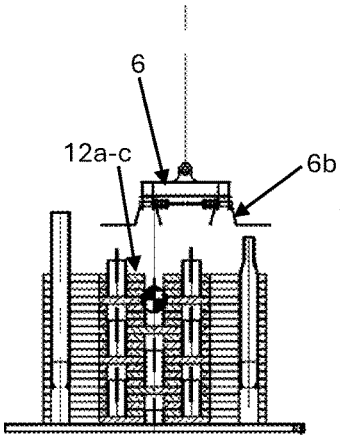
Figure 12E:
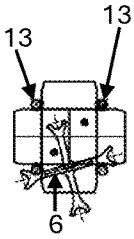
Figure 12F:
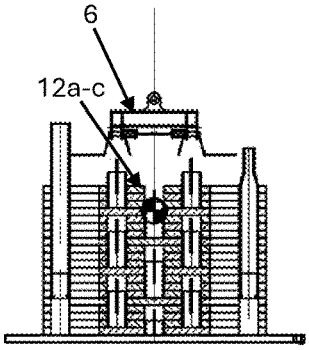
Figure 12G:
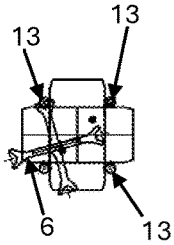
Figure 12H:
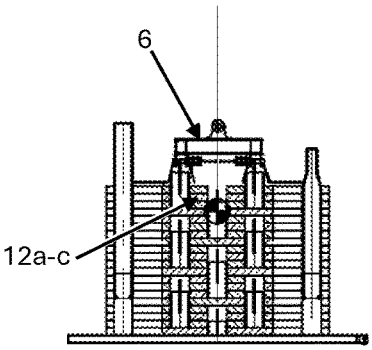
Figure 12I:
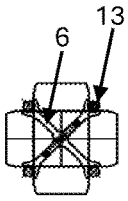
Figure 13:
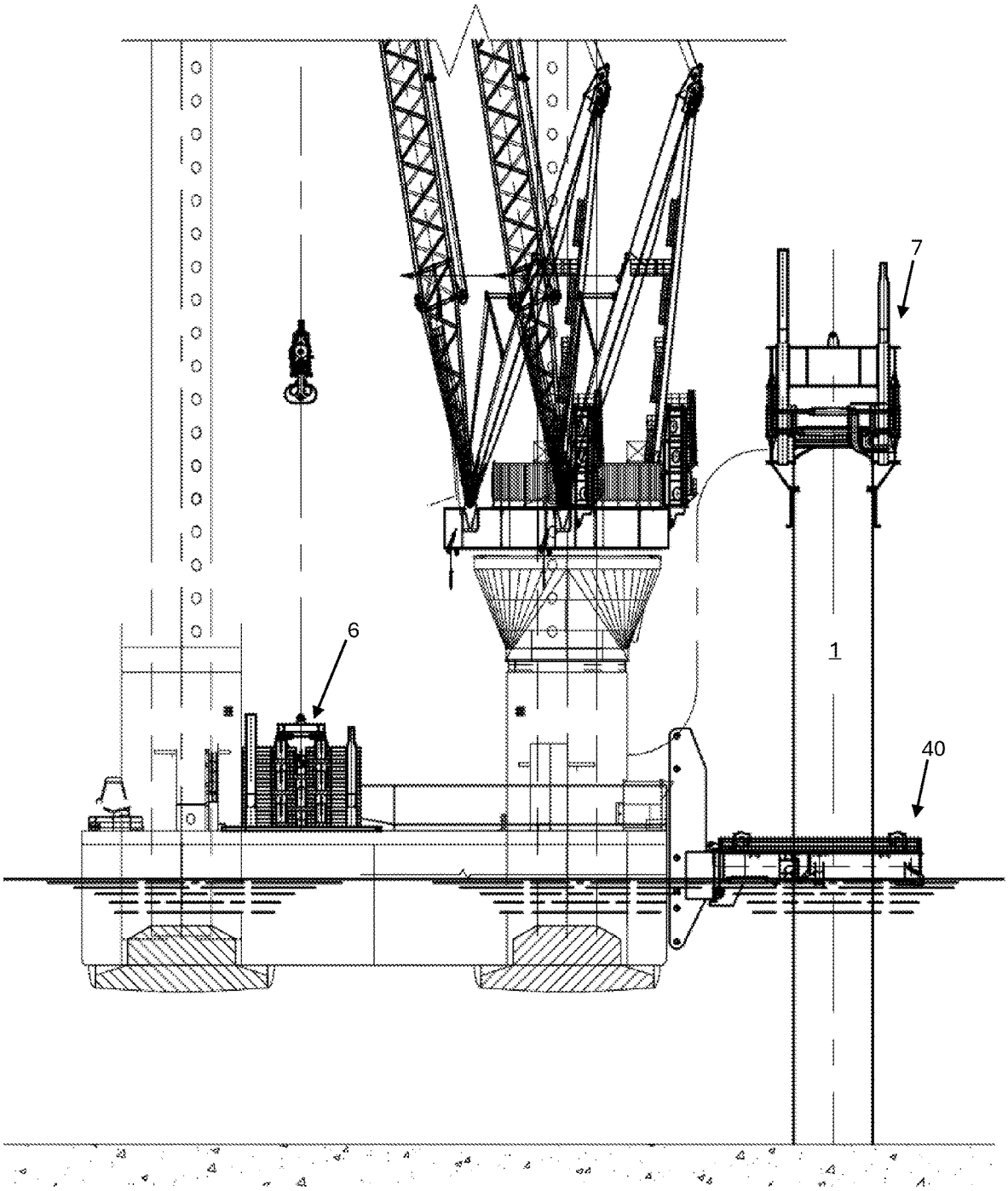
FIG. 13 shows the vessel with the pile driving system of FIG. 4 placed on top of the pile held vertically by the pile holder of the vessel.

In FIG. 12*c* the lifting tool 6 is schematically illustrated. FIGS. 12*c*-12*i* illustrate the lifting tool 6 approaching, engaging and connecting to the uppermost set of drop weight elements 12*a-c*, 12*s* on the stack of drop weight elements 12*a-c*, 12*s* in the storage position. These steps may e.g. be performed during a repeated cycle as discussed above, which is illustrated in FIG. 13.

As shown in FIGS. 12*c*-12*i* the lifting tool 6 is brought with the positioning arms 6*b* thereof into engagement with the pylons 13, so that the tool 6 becomes properly aligned with the connectors 11*n* that are to be coupled to the tool 6.

Figure 14:
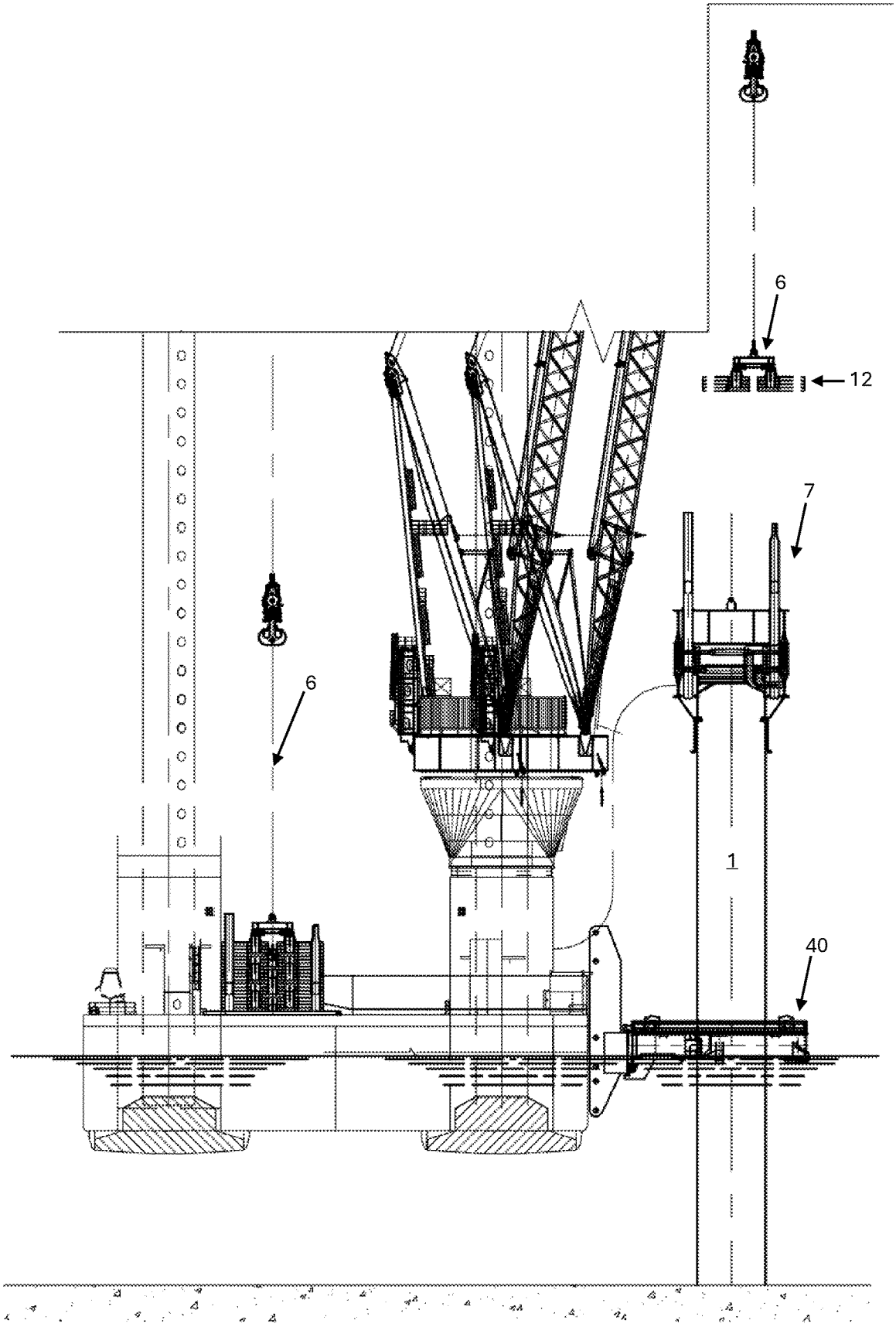
FIG. 14 illustrates the crane being operated while the set of drop weight elements is being lowered to the functional position thereof using the lifting tool.

FIG. 14 illustrates the crane 4 being operated while the set of drop weight elements 12*a-c*, 12*s* is being lowered to the functional position thereof. FIG. 14 illustrates, from top to bottom, that the set approaches the vertical guide members 13 while vertically aligning the openings of the drop weight elements 12*a-c*, 12*s* of the stack therewith, that the leftmost openings are placed around the leftmost guide member 13 and consequently the rightmost openings around the rightmost guide member 13, and that the set is lowered towards the platform of the support structure 11 while being guided by the guide members 13.

In a possible method, the repeated cycle is executed first without any solid drop weight elements being stacked on the support structure 11. This is done e.g. while driving a lower end section of the pile 1 into an uppermost layer of the soil. Usually, driving the pile 1 deeper into the soil requires a greater amount of energy per stroke of the drop weight. The first repeated cycle, without drop weight elements, may thereto e.g. be executed until a predetermined threshold for the blow energy required is reached, after which one or more sets of solid drop weight elements are stacked on the support structure 11 to be added to the drop weight assembly 10, in the way described above. After this the repeated cycle is executed for the second time. This may be repeated a couple of times until the required penetration depth of the pile 1 is reached. So, the second repeated cycle with solid drop weight elements may again be executed until reaching a threshold, e.g. the impact energy threshold, one or more further sets of solid drop weight elements may be added to the drop weight assembly 10. The cycle may again be executed with the increased mass of the drop weight assembly, one or more further sets of drop weight elements may be added to further increase the mass of the drop weight assembly, and so on.

Figure 15A:
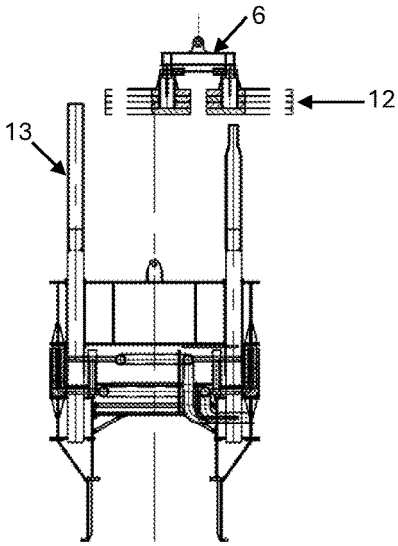
FIGS. 15*a*, 15*c*, 15*e* illustrate placing a set of drop weight elements on the support structure of the drop weight assembly using the lifting tool and a crane in a side view.
Figure 15B:
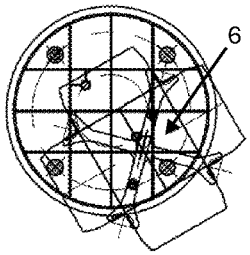
FIGS. 15*b*, 15*d*, 15*f* illustrate the steps of FIGS. 15*a*, 15*c*, 15*e* respectively in a top view, FIG. 16. shows schematically and not to scale, an example a pile driving system according to the second aspect of the invention in a pile driving method for driving a pile, e.g. a hollow and open ended pile.
Figure 15C:
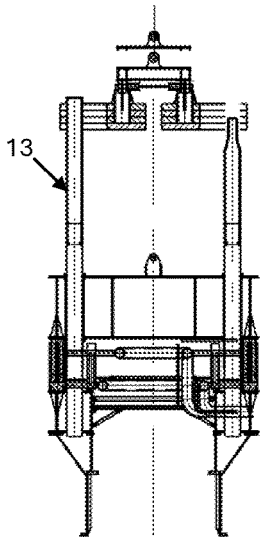
Figure 15D:
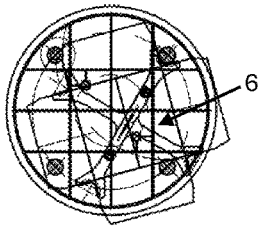
Figure 15E:
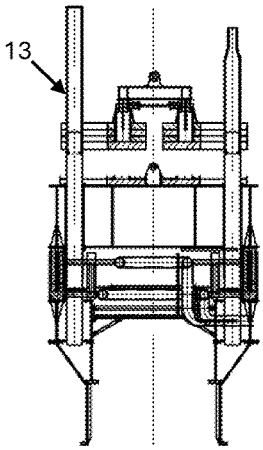
Figure 15F:
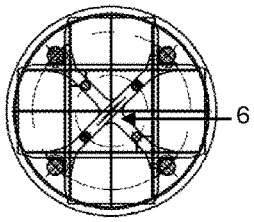

FIGS. 15*a*, 15*c*, 15*e* illustrate placing a set of drop weight elements on the support structure of the drop weight assembly using the lifting tool and a crane in a side view. In FIGS. 15*b*, 15*d*, 15*f* the steps of FIGS. 15*a*, 15*c*, 15*e* respectively are shown in a top view.

In stacking the sets of solid drop weight elements, the tool 6 is rotated back and forth in each consecutive cycle by 90°, to accomplish the earlier mentioned configuration of the sets within the stack on the support structure. In a possible method, after reaching the desired penetration depth, the sets of solid drop weight elements may be moved by the crane 4 to the storage position thereof, while again rotating the tool by 90° back and forth between moving each consecutive set. The pile driving system 7 may be moved to the storage position as well.

Figure 16:
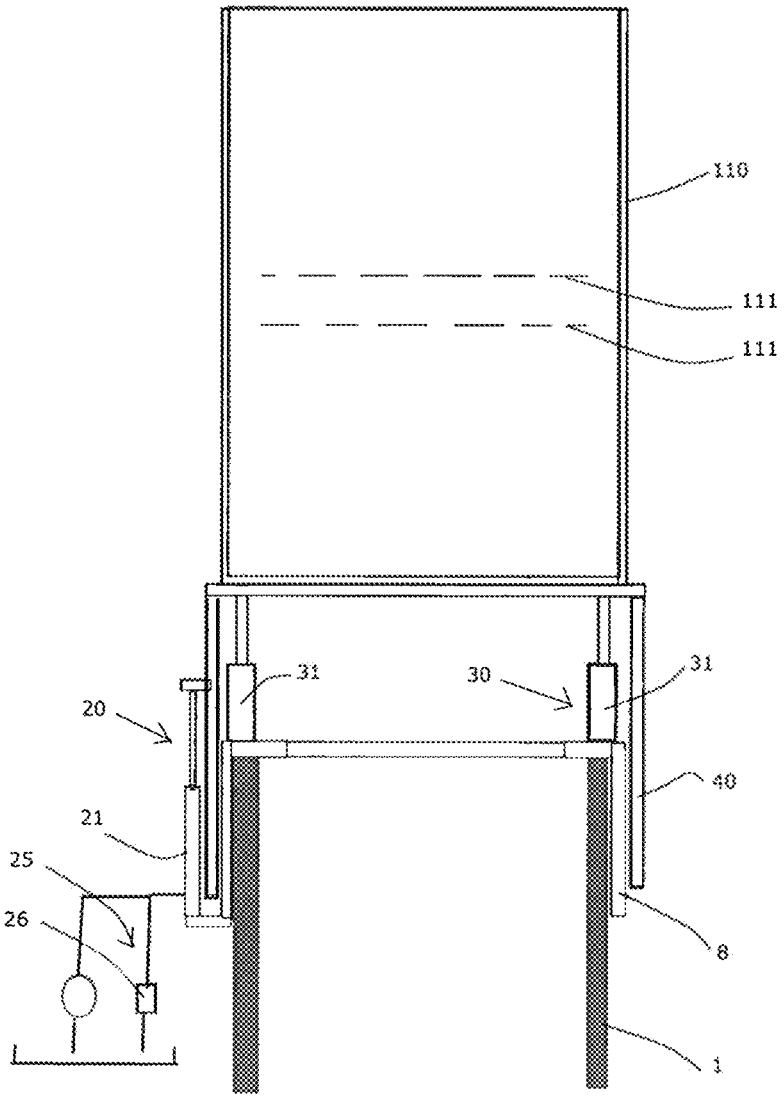

In FIG. 16 it is shown that a pile 1, e.g. a hollow and open ended pile, e.g. a large diameter pile 1 having an outer diameter of at least 5 meters, e.g. a monopile of a wind turbine, is driven into the soil, e.g. into the seabed.

The pile driving system comprises:

- a drive head member 8 that is configured to engage the pile, e.g. is configured to be arranged on the top end of the pile 1,
- a liquid fillable drop tank 110, that has a capacity to hold at least 50 m3, preferably at least 100 m3, e.g. more than 500 m3, e.g. more than 1000 m3, of a liquid therein and that is vertically mobile relative to, here above, the drive head member 8,
- a lift system 20, arranged between the drive head member 8 and the liquid filled drop tank 110, that is configured to bring the liquid filled drop tank into an initial height position relative to the drive head,
- a quick release system 25 that is adapted to effect quick release of the lift system so that the liquid filled drop tank falls down from said initial height position,
- an energy transfer assembly 30 configured for transfer of energy from the falling liquid fillable drop tank 110 to the drive head member 8.

The tank 110 is provided with members 111, e.g. screens, that reduce or avoid sloshing of the liquid, e.g. water, e.g. seawater, in the tank.

As explained herein with reference to the second aspect of the invention, for driving the pile 1 into the soil, the drop tank 110 is at least partially filled with liquid, e.g. water, e.g. seawater, to set the weight of the drop tank.

The method comprising a repeated cycle wherein:

- the liquid filled drop tank 110 is lifted by means of the lift system 20 into a desired initial height position,
- the quick release system 25 is operated to effect quick release of the lift system so that the liquid filled drop tank 110 falls down from said initial height position towards the drive head member.

Herein energy from the falling liquid filled drop tank 110 is transferred by the energy transfer assembly 30 to the drive head member 8 and thereby to the pile 1, here to the top end of the pile, so that the pile 1 is driven deeper into the soil. This cycle is repeated till the desired penetration depth is reached.

As explained it is envisaged that the energy transfer from the drop tank 110 to the pile drive head 8 is devoid of mechanical impact energy transfer between the drop tank 110 and drive head. As shown here the energy transfer assembly is devoid of an anvil.

The energy transfer assembly 30 comprises one or more spring devices and/or one or more damper devices, e.g. embodied like the mentioned oleo-pneumatic integrated spring and damper devices. These devices are here mounted on the drive head 8 in a circular or other shaped array and are effective between the drop tank and the drive head member.

The pile 1 here has an open foot end and an outer diameter of at least 5 meter, e.g. of between 5 and 12 meters. Preferably the pile 1 is hollow over its length.

The liquid fillable drop tank 110 has a capacity to hold at least 100 m3, preferably at least 500 m3, e.g. more than 1000 m3 or more than 2000 m3, of a liquid therein. For example, the tank has a diameter within 0.5 and 1.5 times the outer diameter of the pile 1, e.g. of between 1.0 and 1.5 times the outer diameter of the pile 1.

In embodiments, the energy transfer system 30 comprises multiple gas spring devices, e.g. telescopic devices, each comprising a compressible gas filled variable volume chamber that is compressed with resultant increase of gas pressure upon compression of the liquid filled variable volume chamber by the falling drop tank.

In embodiments, the energy transfer system 30 comprises multiple liquid damper devices, e.g. telescopic devices, each comprising a liquid filled variable volume chamber and an associated liquid flow resistance through which at least a part of said liquid is forced upon compression of the liquid filled variable volume chamber by the falling drop tank.

It is illustrated here that the energy transfer system 30 comprises multiple integrated spring and damper devices 31, these multiple integrated spring and damper devices 31 being arranged in a circular array on the drive head member 8. These devices are vertically telescopic to form one or more chambers for gas and for damping liquid.

Instead of, or in combination with, damping using liquid damping other damping devices can be applied, e.g. based on mechanical friction.

As explained each integrated spring and damper device 31 may comprises a compressible gas filled variable volume chamber that is compressed with resultant increase of gas pressure upon compression of the liquid filled variable volume chamber by the falling drop tank and each integrated spring and damper device comprises a liquid filled variable volume chamber and an associated liquid flow resistance through which at least a part of said liquid is forced upon compression of the liquid filled variable volume chamber by the falling drop tank.

Reference numeral 140 denotes a vertical guide structure that is configured to vertically guide the drop tank 110 relative to the drive head 8. Here a telescoping guide member is provided that is vertically guided relative to the drive head 8. For example, the telescoping guide member comprises an annular guide member surrounding the drive head 8 and having a section protruding above the drive head.

It is illustrated that the one or more spring devices and/or one or more damper devices, e.g. embodied as integrated spring and damper devices 31, are arranged on the drive head member 8, each device 31 engaging at a lower end thereof the drive head 8 and each engaging at an upper end thereof the telescoping guide structure 140, e.g. being connected thereto.

It is illustrated here that an array of multiple spring devices and of multiple damper devices, e.g. embodied as multiple integrated spring and damper devices 31, is arranged within the annular guide member 140.

As preferred, the lift mechanism comprises multiple hydraulic lift cylinders 21. The quick release system 25 comprises one or more quick release valves 26 that are opened to allow rapid discharge of hydraulic liquid from the lift cylinders. As preferred the hydraulic liquid of the one or more lift cylinders 21 is circulated through a heat exchanger system so as to cool the hydraulic liquid, e.g. said heat exchanger being fed with seawater for cooling the circulated hydraulic liquid in case the pile is installed into the seabed.

As preferred, the liquid of the multiple liquid damper devices 31 is circulated through a heat exchanger system so as to cool said liquid, e.g. a volume of liquid in the circulation circuit being at least 10 times greater than the volume of the liquid filled variable volume chambers of the multiple liquid damper devices, e.g. the heat exchanger being fed with seawater for cooling the circulated damper liquid in case the pile is installed into the seabed.

Whilst the figures illustrates that the tank 110 is embodied with a single cavity for storage of the liquid, an alternative design provides for the liquid fillable drop tank to comprise a group of tank members, e.g. a group of pipe sections, e.g. cylindrical pipe sections, the group of tank members being mounted on a common tank frame, each tank member being fillable with a volume of liquid.

Figure 17:
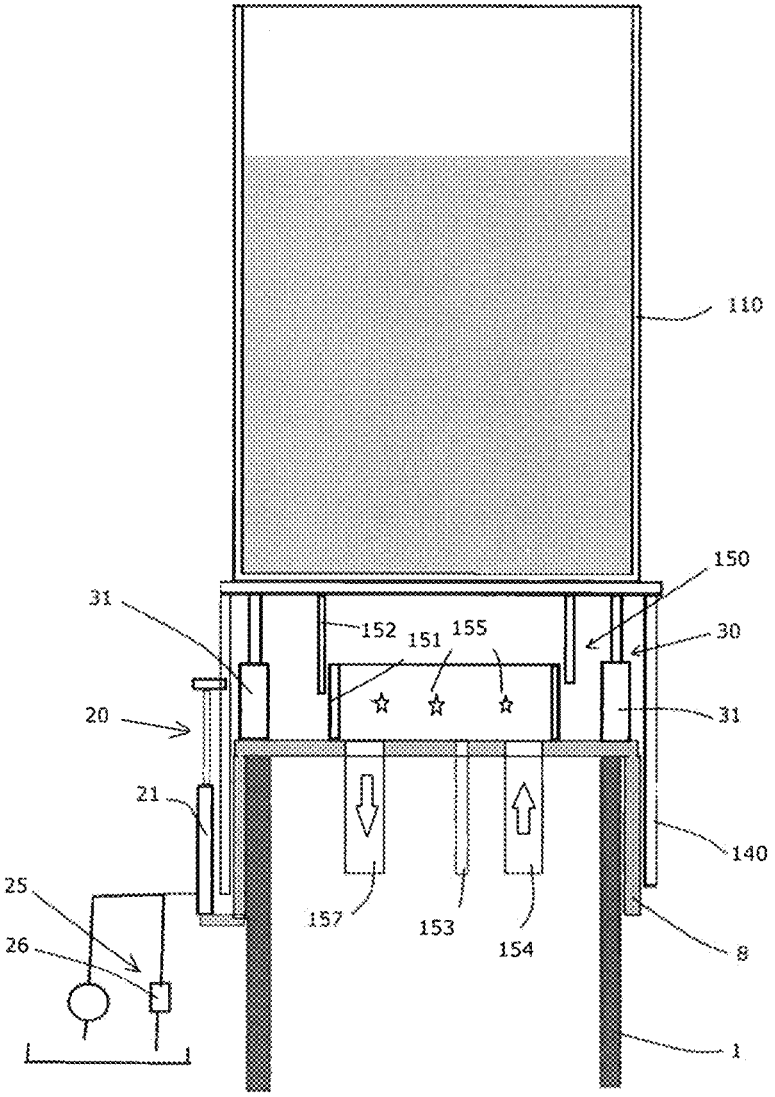
FIG. 17 shows an alternative pile driving system according to the invention in a pile driving method for driving a pile, e.g. a hollow and open ended pile.

FIG. 17 shows a pile driving method and system having many similarities with the system of FIG. 16, the same components being denoted with the same reference numerals.

The pile driving system further comprises one or more telescoping fuel combustion operated devices 150 arranged to be effective between the drop tank and the drive head and, in operation, providing a fuel combustion based blow onto the drive head 8 in addition to the energy transferred from the falling drop tank 110. In practical embodiments, the pile driving device comprises a telescoping fuel combustion operated device having a first combustion chamber member 151 mounted to the drive head, and a second combustion chamber member 152 mounted to the drop tank, the first and second combustion chamber member being vertically telescoping relative to one another. A supply 153 of fuel and air 154, or of a fuel/air mixture are envisaged as well as an igniter 155 to ignite the fuel/air mixture in the telescopic combustion chamber. As a result of ignition the fuel/air mixture will combust, preferably very fast as a sort of detonation. The sudden increase of pressure in the chamber causes an impulse downward on the pile 1, as the upward resultant is absorbed by the mass of the drop tank. In embodiments ignition is timed just before, during, or just after the falling of the drop tank.

In embodiments with one or more telescoping fuel combustion operated devices as indicated above, the energy transfer onto the pile can be shaped even more than with just the provision of the drop tank. For example, the ignition, as well as the combustive power of the fuel/air mixture, can be adjusted to obtain first a short impulse onto the pile 1, followed by a longer duration transfer of energy from the falling drop tank 110 (which may have been released right at the moment of ignition or at another suitable moment in view of the desired profile of the force onto the pile by the pile driving system).

In embodiments, combustion gas can readily leave the telescopic chamber via one or more vent openings, possibly a vent opening 157 being permanently present between the first and second combustion chamber members 151, 152. In an embodiment venting of combustion gas from the combustion chamber is controlled by a controllable vent valve. The latter may, in embodiments, allow for keeping the combustion chamber in an enclosed telescopic combustion chamber member for a while after ignition, e.g. so that the combustion gas acts as a gas cushion for the falling drop tank.

In embodiments, it is envisaged that the power of the combustion is selected such that the drop tank is not lifted due to the combustion. As indicated above, ignition may be timed to occur during the actual fall of the drop tank, e.g. during the falling drop tank already interacting with the associated spring devices and/or damper devices.

What is claimed is:

1. A pile driving system for driving a pile into soil, comprising:

a drive head member configured to be arranged on a top end of the pile to engage the pile;

a liquid fillable drop tank, that has a capacity to hold more than 500 m3 of a liquid therein and that is vertically mobile above and relative to the drive head member;

a lift system configured to bring the drop tank into an initial height position relative to the drive head member;

a quick release system adapted to effect quick release of the lift system so that the drop tank falls down from said initial height position; and an energy transfer assembly configured for transfer of energy from the drop tank to the drive head member, wherein the pile driving system is operable in a repeated cycle for driving the pile into the soil, and wherein energy from the drop tank is transferred by said energy transfer assembly to the drive head member and thereby to the pile.

2. The pile driving system according to claim 1, wherein the system is configured to drive a hollow and open ended, large diameter pile having an outer diameter of at least 5 meters into the soil.

3. The pile driving system according to claim 1, wherein the system is configured to drive a monopile of an offshore wind turbine into the soil.

4. The pile driving system according to claim 1, wherein the drive head member has a mass of more than 500 tonnes.

5. The pile driving system according to claim 1, wherein the lift system is arranged between the drive head member and the drop tank.

6. The pile driving system according to claim 1, wherein said energy transfer assembly comprises one or more spring devices that are effective between the drop tank and the drive head member.

7. The pile driving system according to claim 6, wherein the one or more spring devices are arranged on the drive head member, each spring device engaging at a lower end of the drive head member.

8. The pile driving system according to claim 6, wherein the one or more spring devices are a plurality of spring devices which are arranged in an array underneath the drop tank.

9. The pile driving system according to claim 6, wherein the one or more spring devices are a plurality of spring devices arranged in a circular array on the drive head member.

10. The pile driving system according to claim 1, wherein said energy transfer assembly comprises one or more liquid damper devices that are effective between the drop tank and the drive head member, each of the liquid damper devices comprising a liquid filled variable volume chamber and an associated liquid flow resistance through which at least a part of said liquid is forced upon compression of the liquid filled variable volume chamber as the drop tank falls.

11. The pile driving system according to claim 10, wherein the one or more liquid damper devices are arranged on the drive head member, each damper device engaging at a lower end of the drive head member.

12. The pile driving system according to claim 10, wherein the one or more liquid damper devices are a plurality of liquid damper devices which are arranged in an array underneath the drop tank.

13. The pile driving system according to claim 10, wherein the one or more liquid damper devices are a plurality of liquid damper devices arranged in a circular array on the drive head member.

14. The pile driving system according to claim 1, wherein the drop tank is releasable to fall solely based on gravity and in a non-submerged situation, without any downward acceleration of the drop tank in addition to gravitational acceleration.

15. The pile driving system according to claim 1, wherein the drop tank is devoid of any vertically movable piston type bottom within the drop tank, and the bottom of the drop tank is not made as a piston upon which a liquid mass rests.

16. The pile driving system according to claim 1, wherein the energy transfer from the drop tank to the drive head member is devoid of a mechanical impact energy transfer between the drop tank and the drive head member.

17. The pile driving system according to claim 1, wherein the energy transfer assembly is devoid of an anvil.

18. The pile driving system according to claim 1, wherein the energy transfer assembly is vertically aligned with a longitudinal wall of the pile.

19. The pile driving system according to claim 1, further comprising a vertical guide structure that is configured to vertically guide the drop tank relative to the drive head member.

20. A marine vessel, provided with a pile driving system according to claim 1.

* * * * *